US009304432B2

(12) United States Patent
Shimizu et al.

(10) Patent No.: US 9,304,432 B2
(45) Date of Patent: Apr. 5, 2016

(54) IMAGE FORMING APPARATUS

(71) Applicant: KYOCERA Document Solutions Inc., Osaka-shi, Osaka (JP)

(72) Inventors: Tamotsu Shimizu, Osaka (JP); Yukihiro Mori, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/506,756

(22) Filed: Oct. 6, 2014

(65) Prior Publication Data

US 2015/0104208 A1 Apr. 16, 2015

(30) Foreign Application Priority Data

Oct. 11, 2013 (JP) ..... 2013-213629
Jul. 23, 2014 (JP) ..... 2014-149994

(51) Int. Cl.
*G03G 15/06* (2006.01)
*G03G 15/09* (2006.01)
*G03G 15/08* (2006.01)

(52) U.S. Cl.
CPC ..... *G03G 15/065* (2013.01); *G03G 15/0907* (2013.01); *G03G 15/0898* (2013.01)

(58) Field of Classification Search
USPC ..... 399/55
See application file for complete search history.

(56) References Cited

U.S. PATENT DOCUMENTS

2010/0054820 A1 3/2010 Fujihara et al.
2015/0261127 A1* 9/2015 Fujishima ..... G03G 15/0907 399/55

FOREIGN PATENT DOCUMENTS

JP 2010-54743 3/2010

* cited by examiner

*Primary Examiner* — Minh Phan
(74) *Attorney, Agent, or Firm* — Gerald E. Hespos; Michael J. Porco; Matthew T. Hespos

(57) ABSTRACT

An image forming apparatus includes an image carrier, a developing device, a bias applying unit, a leak detecting unit, a bias controller and a leak detection controller. The developing device includes a magnetic roller and a developer layer. The bias applying unit applies development biases to the magnetic roller and the developing roller. The leak detecting unit detects a leak generated between the image carrier and the developing roller or a leak generated between the developing roller and the magnetic roller. The leak detection controller performs a leak detecting operation for detecting the value of an inter-peak voltage of the alternating current voltage of the development bias applied to the developing roller, at which the leak is generated, while changing the inter-peak voltage at a time different from that during the developing operation.

20 Claims, 16 Drawing Sheets

FIG.12

| | 1st STEP | 1st LEAK GENERATED | | 2nd STEP | 2nd LEAK GENERATED | | 3rd STEP | 3rd LEAK GENERATED |
|---|---|---|---|---|---|---|---|---|
| 1 | A - 1 | ○ | 1 | A - 1 | ○ | 1 | A - 1 | ○ |
| 2 | B - 1 | ○ | | | | | | |
| 3 | C - 1 | ○ | 2 | C - 1 | ○ | 2 | C - 1 | ○ |
| 4 | D - 1 | ○ | | | | | | |
| 5 | E - 1 | ○ | 3 | E - 1 | ○ | 3 | E - 1 | ○ |
| 6 | F - 1 | ○ | | | | | | |
| 7 | G - 1 | ○ | 4 | G - 1 | ○ | 4 | G - 1 | ○ |
| 8 | H - 1 | ○ | | | | | | |
| 9 | I - 1 | ○ | 5 | I - 1 | ○ | 5 | I - 1 | ○ |
| 10 | J - 1 | ○ | | | | | | |
| 11 | K - 1 | ○ | 6 | K - 1 | ○ | 6 | K - 1 | ○ |
| 12 | L - 1 | ○ | 7 | L - 1 | ○ | 7 | L - 1 | ○ |
| 13 | M - 1 | × | 8 | M - 1 | × | 8 | M - 1 | × |
| 14 | L - 2 | ○ | 9 | L - 2 | ○ | 9 | L - 2 | ○ |
| 15 | L - 3 | × | 10 | L - 3 | × | 10 | L - 3 | × |

FIG.14

1st

| | STEP | LEAK GENERATED |
|---|---|---|
| 1 | A - 1 | ○ |
| 2 | B - 1 | ○ |
| 3 | C - 1 | ○ |
| 4 | D - 1 | ○ |
| 5 | E - 1 | ○ |
| 6 | F - 1 | ○ |
| 7 | G - 1 | ○ |
| 8 | H - 1 | ○ |
| 9 | I - 1 | ○ |
| 10 | J - 1 | ○ |
| 11 | K - 1 | ○ |
| 12 | L - 1 | ○ |
| 13 | M - 1 | × |
| 14 | L - 2 | ○ |
| 15 | L - 3 | × |

2nd

| | STEP | LEAK GENERATED |
|---|---|---|
| 1 | A - 1 | ○ |
| | | |
| 2 | C - 1 | ○ |
| | | |
| 3 | E - 1 | ○ |
| | | |
| 4 | G - 1 | ○ |
| | | |
| 5 | I - 1 | ○ |
| | | |
| 6 | K - 1 | ○ |
| 7 | K - 2 | ○ |
| 8 | K - 3 | ○ |
| 9 | K - 4 | ○ |
| 10 | K - 5 | ○ |
| 11 | L - 1 | ○ |
| 12 | L - 2 | ○ |
| 13 | L - 3 | × |

3rd

| | STEP | LEAK GENERATED |
|---|---|---|
| 1 | A - 1 | ○ |
| | | |
| 2 | C - 1 | ○ |
| | | |
| 3 | E - 1 | ○ |
| | | |
| 4 | G - 1 | ○ |
| | | |
| 5 | I - 1 | ○ |
| | | |
| 6 | K - 1 | ○ |
| 7 | K - 2 | ○ |
| 8 | K - 3 | ○ |
| 9 | K - 4 | ○ |
| 10 | K - 5 | ○ |
| 11 | L - 1 | ○ |
| 12 | L - 2 | ○ |
| 13 | L - 3 | × |

FIG.15

| | 1st STEP | 1st LEAK GENERATED | | 2nd STEP | 2nd LEAK GENERATED | | 3rd STEP | 3rd LEAK GENERATED |
|---|---|---|---|---|---|---|---|---|
| 1 | A - 1 | ○ | 1 | A - 1 | ○ | 1 | A - 1 | ○ |
| 2 | B - 1 | ○ | | | | | | |
| 3 | C - 1 | ○ | | | ○ | | | ○ |
| 4 | D - 1 | ○ | | | | | | |
| 5 | E - 1 | ○ | 2 | E - 1 | ○ | 2 | E - 1 | ○ |
| 6 | F - 1 | ○ | | | | | | |
| 7 | G - 1 | ○ | | | | | | |
| 8 | H - 1 | ○ | 3 | H - 1 | ○ | 3 | H - 1 | ○ |
| 9 | I - 1 | ○ | | | | | | |
| 10 | J - 1 | ○ | 4 | J - 1 | ○ | 4 | J - 1 | ○ |
| 11 | K - 1 | ○ | 5 | K - 1 | ○ | 5 | K - 1 | ○ |
| 12 | L - 1 | ○ | 6 | L - 1 | ○ | 6 | L - 1 | ○ |
| 13 | M - 1 | × | 7 | M - 1 | × | 7 | M - 1 | × |
| 14 | L - 2 | ○ | 8 | L - 2 | ○ | 8 | L - 2 | ○ |
| 15 | L - 3 | × | 9 | L - 3 | × | 9 | L - 3 | × |

IMAGE FORMING APPARATUS

INCORPORATION BY REFERENCE

This application is based on Japanese Patent Application No. 2013-213629 filed with the Japan Patent Office on Oct. 11, 2013 and Japanese Patent Application No. 2014-149994 filed with the Japan Patent Office on Jul. 23, 2014, the contents of which are hereby incorporated by reference.

BACKGROUND

The present disclosure relates to an image forming apparatus provided with a developing device.

An electrophotographic image forming apparatus such as a copier, a printer or a facsimile machine forms a toner image on an image carrier (e.g. photoconductive drum or transfer belt) by supplying toner to an electrostatic latent image formed on the image carrier to develop the electrostatic latent image. A touch-down development method using two-component developer containing nonmagnetic toner and magnetic carrier is known as one method for the development. In this case, a two-component developer layer (so-called magnetic brush layer) is carried on a magnetic roller, the toner is moved onto a developing roller from the two-component developer layer and a toner layer is carried. Further, the electrostatic latent image is visualized by supplying the toner from the toner layer to the image carrier.

SUMMARY

An image forming apparatus according to one aspect of the present disclosure includes an image carrier, a developing device, a bias applying unit, a leak detecting unit, a bias controller and a leak detection controller. An electrostatic latent image is formed and a toner image is carried on a surface of the image carrier. The developing device includes a development housing configured to store developer containing toner to be charged to a predetermined polarity and carrier, a magnetic roller configured to receive the developer in the development housing and carry a developer layer by being rotated and a developing roller configured to receive the toner from the developer layer, carry a toner layer and supply the toner to the image carrier by being rotated in a state held in contact with the developer layer. The bias applying unit applies development biases, in which an alternating current voltage is superimposed on a direct current voltage, to the magnetic roller and the developing roller. The leak detecting unit detects a leak generated between the image carrier and the developing roller or a leak generated between the developing roller and the magnetic roller. The bias controller controls the bias applying unit to provide a potential difference between the magnetic roller and the developing roller so that the toner moves from the magnetic roller to the developing roller during a developing operation in which the toner is supplied from the developing roller to the image carrier. The leak detection controller performs a leak detecting operation for detecting the value of an inter-peak voltage of the alternating current voltage of the development bias applied to the developing roller, at which the leak is generated, while changing the inter-peak voltage at a time different from that during the developing operation. The leak detection controller successively performs a plurality of the leak detecting operations at predetermined timings. The leak detection controller increases the inter-peak voltage from a preset reference detection starting voltage and detects the inter-peak voltage when the leak is detected as a leak generating voltage in the first one of the plurality of leak detecting operations. The leak detection controller increases the inter-peak voltage from a first detection starting voltage calculated according to the already detected leak generating voltage and higher than the reference detection starting voltage and detects the inter-peak voltage when the leak is detected as the next leak generating voltage in the second or subsequent leak detecting operation.

These and other objects, features and advantages of the present disclosure will become more apparent upon reading the following detailed description along with the accompanying drawings.

BRIEF DESCRIPTION OF THE DRAWINGS

FIG. 12 is a diagram showing steps of a leak detecting operation according to a third embodiment of the present disclosure, FIG. 14 is a diagram showing steps of a leak detecting operation according to a modification of the present disclosure, FIG. 15 is a diagram showing steps of the leak detecting operation according to a modification of the present disclosure.

DETAILED DESCRIPTION

Hereinafter, embodiments of the present disclosure are described in detail based on the drawings. Note that the present disclosure can be applied to an electrophotographic image forming apparatus such as a copier, a printer, a facsimile machine or a complex machine provided with these functions.

Figure 1:
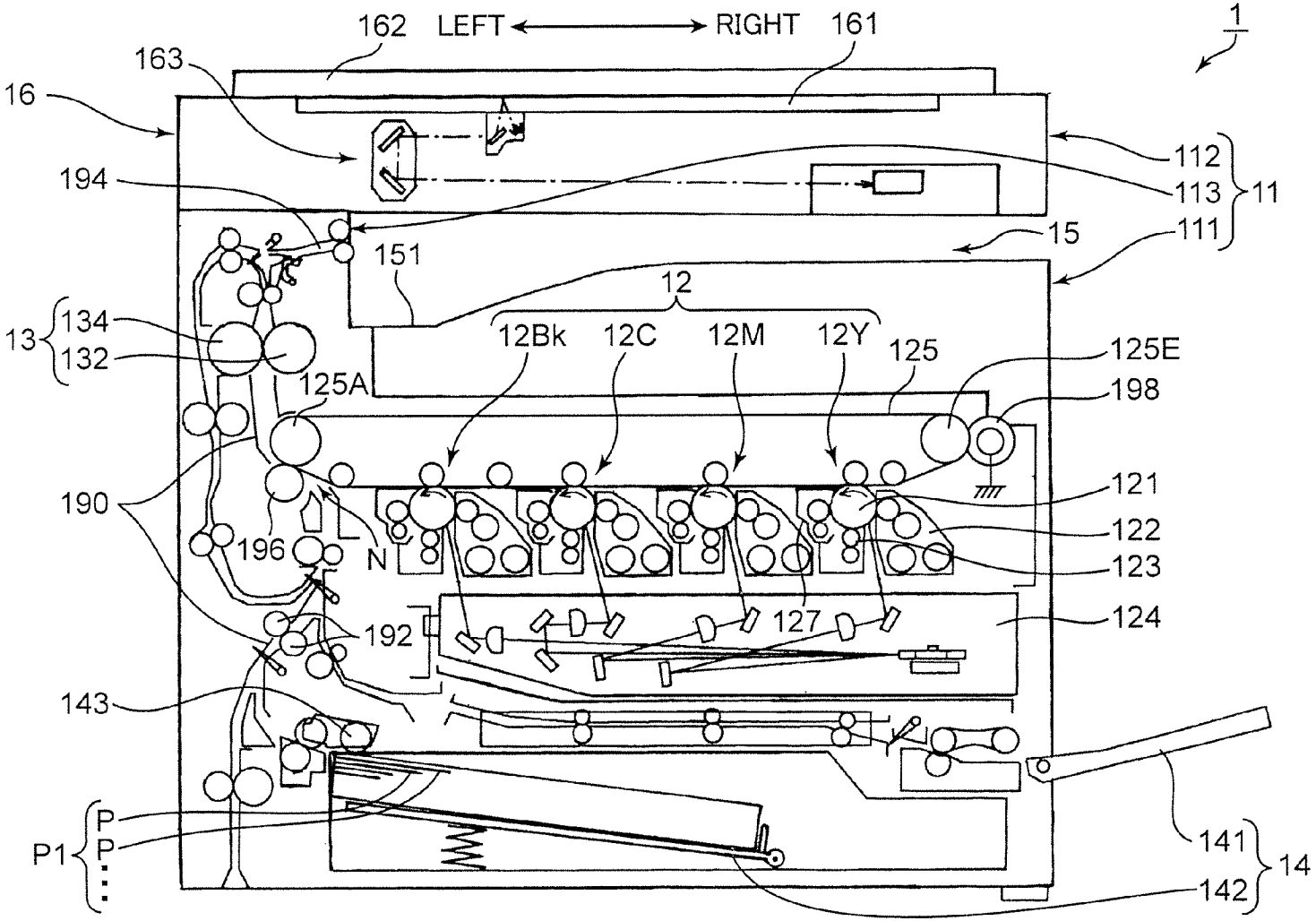
FIG. 1 is a sectional view showing the internal structure of an image forming apparatus according to an embodiment of the present disclosure.

FIG. 1 is a front sectional view showing the structure of an image forming apparatus 1 according to one embodiment of the present disclosure. The image forming apparatus 1 includes an image forming station 12, a fixing device 13, a sheet feeding unit 14, a sheet discharging unit 15, a document reading unit 16 and the like in an apparatus main body 11.

The apparatus main body 11 includes a lower main body 111, an upper main body 112 arranged to face the lower main body 111 from above and a coupling part 113 interposed between the upper main body 112 and the lower main body 111. The coupling part 113 is a structure for coupling the lower main body 111 and the upper main body 112 to each other in a state where the sheet discharging unit 15 is formed between the lower main body 111 and the upper main body 112, and is erected on left and rear parts of the lower main body 111 and L-shaped in a plan view. The upper main body 112 is supported on an upper end part of the coupling part 113.

The image forming station 12, the fixing device 13 and the sheet feeding unit 14 are housed in the lower main body 111 and the document reading unit 16 is mounted in the upper main body 112.

The image forming station 12 performs an image forming operation of forming a toner image on a sheet P fed from the sheet feeding unit 14. The image forming station 12 includes a yellow unit 12Y using yellow toner, a magenta unit 12M using magenta toner, a cyan unit 12C using cyan toner and a black unit 12Bk using black toner successively arranged in a horizontal direction from an upstream side toward a downstream side, an intermediate transfer belt 125 stretched on a plurality of rollers including a drive roller 125A in such a manner as to be able to endlessly travel in a sub scanning direction in image formation, a secondary transfer roller 196 held in contact with the outer peripheral surface of the intermediate transfer belt 125 and a belt cleaning device 198.

The unit of each color of the image forming station 12 integrally includes a photoconductive drum 121, a developing device 122 for supplying the toner to the photoconductive drum 121, a toner cartridge (not shown) for storing the toner, a charging device 123 and a drum cleaning device 127. Further, an exposure device 124 for exposing each photoconductive drum 121 to light is horizontally arranged below the adjacent developing devices 122.

The photoconductive drum 121 has an electrostatic latent image formed on the circumferential surface thereof and carries a toner image obtained by developing the electrostatic latent image with the toner.

The developing device 122 attaches the toner by supplying the toner to an electrostatic latent image on the circumferential surface of the photoconductive drum 121 rotating in a direction of an arrow and forms a toner image corresponding to image data on the circumferential surface of the photoconductive drum 121. The toner is appropriately supplied to each developing device 122 from the toner cartridge.

The charging device 123 is provided at a position right below each photoconductive drum 121. The charging device 123 uniformly charges the circumferential surface of each photoconductive drum 121.

The exposure device 124 is provided at a position below each charging device 123. The exposure device 124 forms an electrostatic latent image on the circumferential surface of each photoconductive drum 121 by irradiating laser light corresponding to each color and based on image data input from a computer or the like or image data obtained by the document reading unit 16 to the charged circumferential surface of the photoconductive drum 121. Note that since the exposure device 124 irradiates the laser light according to a preset exposure light quantity to form a predetermined latent image potential on the photoconductive drum 121. The drum cleaning device 127 is provided at a position to the left of each photoconductive drum 121 and cleans the circumferential surface of the photoconductive drum 121 by removing the residual toner thereon.

The intermediate transfer belt 125 is an endless belt and an electrically conductive soft belt having a laminated structure composed of a base layer, an elastic layer and a coating layer. The intermediate transfer belt 125 is mounted on a plurality of stretching rollers arranged substantially in the horizontal direction above the image forming station 12. The stretching rollers include the drive roller 125A arranged near the fixing device 13 to drive and rotate the intermediate transfer belt 125 and a driven roller 125E arranged at a predetermined distance from the drive roller 125A in the horizontal direction and rotated, following the rotation of the drive roller 125A. The intermediate transfer belt 125 is driven to rotate in a clockwise direction in FIG. 1 by applying a rotational drive force to the drive roller 125A.

A secondary transfer bias applying unit (not shown) is electrically connected to the secondary transfer roller 196. A toner image formed on the intermediate transfer belt 125 is transferred to a sheet P conveyed from a pair of conveyer rollers below by a transfer bias applied to between the secondary transfer roller 196 and the drive roller 125A. The belt cleaning device 198 arranged to face the driven roller 125E via the intermediate transfer belt 125 is arranged at an outer side of the driven roller 125E.

The fixing device 13 includes a heating roller 132 with an electric heat element such as a halogen lamp as a heating source inside, and a pressure roller 134 arranged to face the heating roller 132. The fixing device 13 applies a fixing process to a toner image on a sheet P transferred in the image forming station 12 by applying heat from the heating roller 132 while the sheet P passes through a fixing nip portion between the heating roller 132 and the pressure roller 134. The color printed sheet P finished with the fixing process is discharged toward a sheet discharge tray 151 provided on the top of the apparatus main body 11 through a discharge sheet conveyance path 194 extending from an upper part of the fixing device 13.

The sheet feeding unit 14 includes a manual feed tray 141 openably and closably provided on the right side wall of the apparatus main body 11 in FIG. 1 and a sheet cassette 142 detachably mounted at a position below the exposure device 124 in the apparatus main body 11. The sheet cassette 142 stores a sheet stack P1 formed by stacking a plurality of sheets P. A pickup roller 143 is provided above the sheet cassette 142 and feeds the uppermost sheet P of the sheet stack P1 stored in the sheet cassette 142 to a sheet conveyance path 190. The manual feed tray 141 is a tray provided at a lower position of the right surface of the lower main body 111 for manually feeding sheets P one by one toward the image forming station 12.

The vertically extending sheet conveyance path 190 is formed at a position to the left of the image forming station 12. The pair of conveyor rollers 192 are provided at a suitable position in the sheet conveyance path 190 and conveys the sheet P fed from the sheet feeding unit 14 toward a secondary transfer nip portion including the secondary transfer roller 196.

The sheet discharging unit 15 is formed between the lower main body 111 and the upper main body 112. The sheet discharging unit 15 includes the sheet discharge tray 151 formed on the upper surface of the lower main body 111. The sheet discharge tray 151 is a tray to which the sheet P having a toner image formed thereon in the image forming station 12 is discharged after the fixing process is applied thereto in the fixing device 13.

The document reading unit 16 includes a contact glass 161 which is mounted in an upper surface opening of the upper main body 112 and on which a document is to be placed, an openable and closable document pressing cover 162 which presses a document placed on the contact glass 161 and a scanning mechanism 163 which scans and reads an image of a document placed on the contact glass 161. The scanning mechanism 163 optically reads an image of a document using an image sensor such as a CCD (Charge Coupling Device) or a CMOS (Complementary Metal oxide Semiconductor) and generates image data. Further, the apparatus main body 11 includes an image processing unit (not shown) for generating an image from this image data.

<Configuration of Developing Device>

Figure 2:
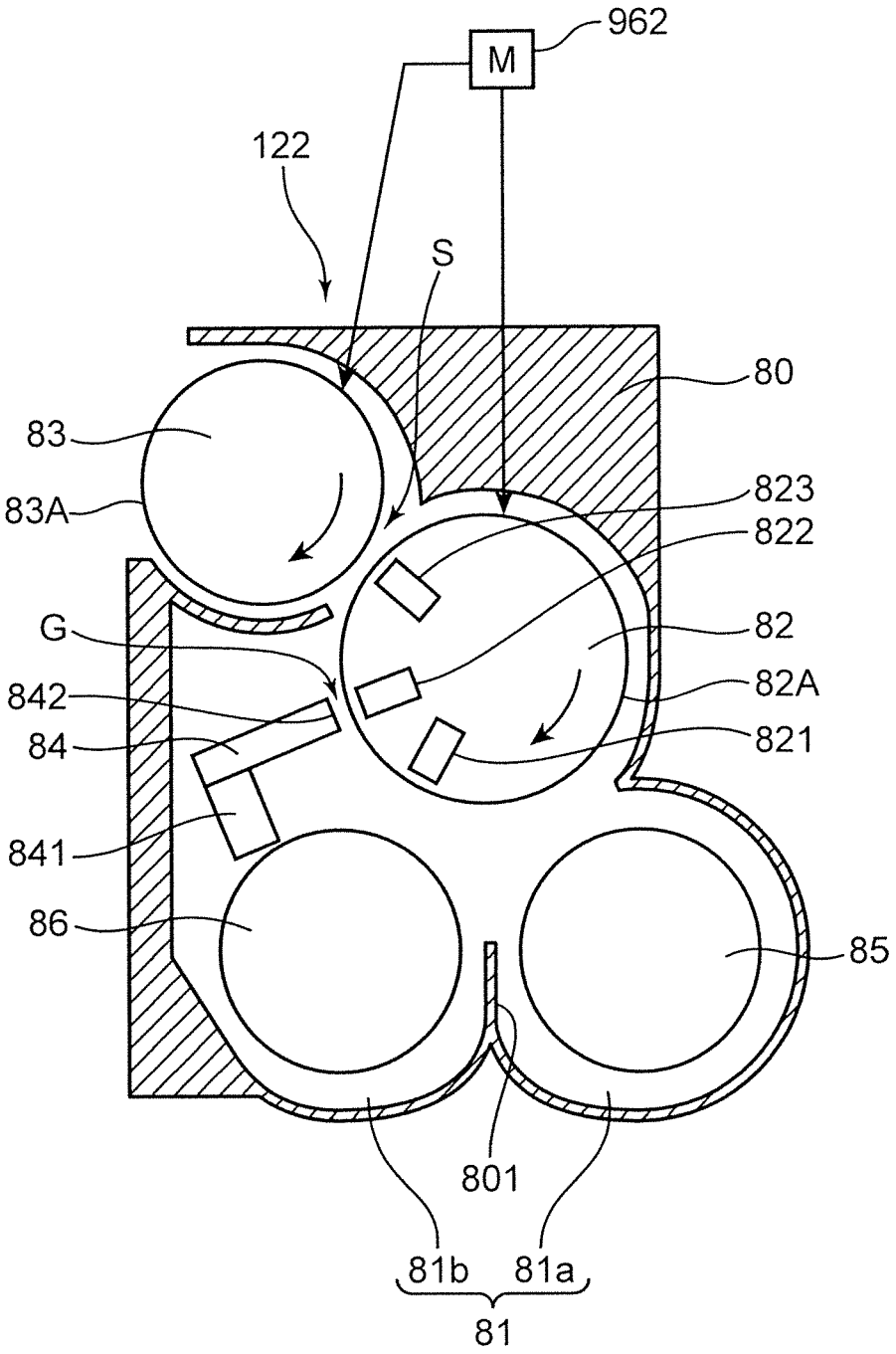
FIG. 2 is a sectional view of a developing device according to the embodiment of the present disclosure.
Figure 3:
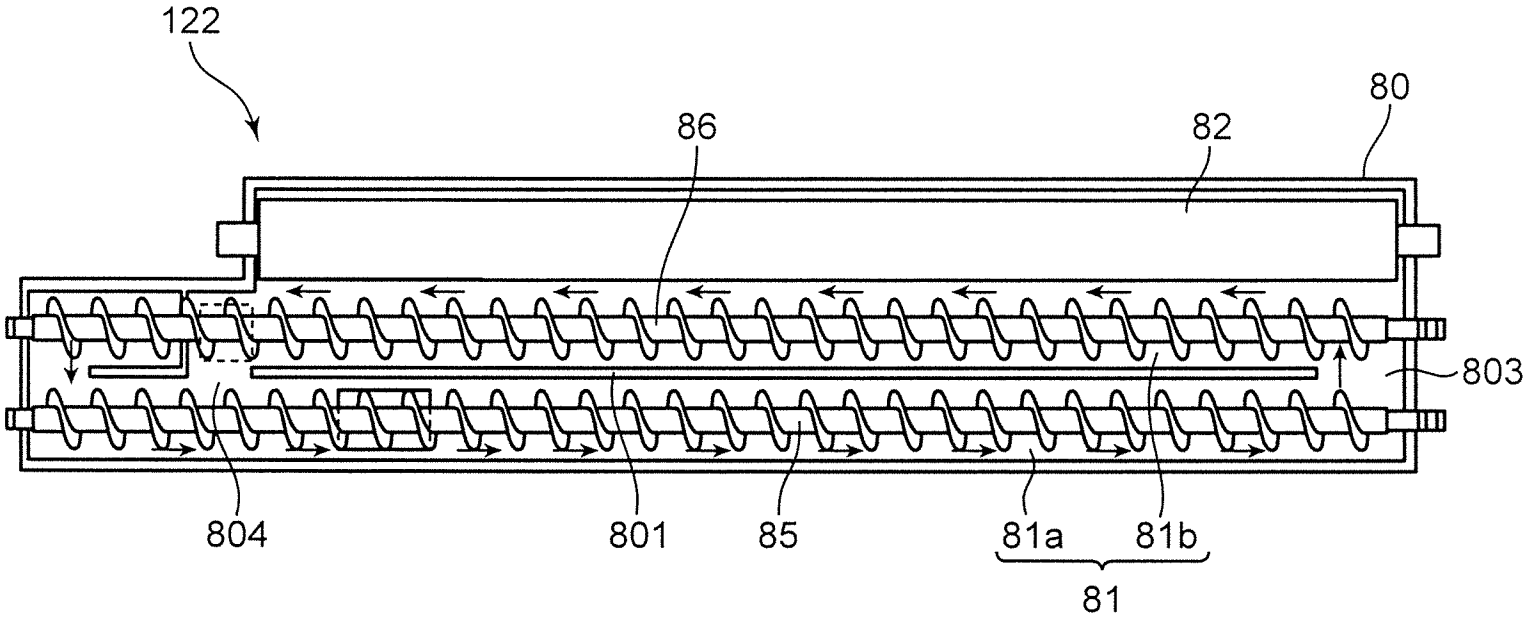
FIG. 3 is a plan view showing the internal structure of the developing device according to the embodiment of the present disclosure.

Next, the developing device 122 is described in detail. FIG. 2 is a vertical and transverse sectional view schematically showing the internal structure of the developing device 122, and FIG. 3 is a plan view showing the internal structure of the developing device 122. The developing device 122 includes a development housing 80 defining an internal space of the developing device 122. A developer storing unit 81 for storing developer containing nonmagnetic toner to be charged to a predetermined polarity and magnetic carrier is provided in this development housing 80. An average particle diameter of the toner is 6.8 μm. Further, a magnetic roller 82 arranged above the developer storing unit 81, a developing roller 83 arranged to face the magnetic roller 82 at a position obliquely above the magnetic roller 82 and a developer restricting blade 84 arranged to face the magnetic roller 82 are arranged in the development housing 80.

The developer storing unit 81 includes two developer storage chambers 81*a*, 81*b* adjacent to each other and extending in a longitudinal direction of the developing device 122. The developer storage chambers 81*a*, 81*b* are integrally formed to the development housing 80 and partitioned from each other by a partition plate 801 extending in the longitudinal direction, but communicate with each other through communication passages 803, 804 at opposite end parts in the longitudinal direction as shown in FIG. 3. Screw feeders 85, 86 for agitating and conveying the developer by rotating about axes are housed in the respective developer storage chambers 81*a*, 81*b*. The screw feeders 85, 86 are driven and rotated by an unillustrated driving mechanism, and rotating directions thereof are set to be opposite to each other. This causes the developer to be conveyed in a circulating manner while being agitated between the developer storage chambers 81*a* and 81*b* as shown by arrows in FIG. 3. By this agitation, the toner and the carrier are mixed and the toner is, for example, positively charged.

The magnetic roller 82 is arranged along the longitudinal direction of the developing device 122 and driven to rotate in a clockwise direction in FIG. 2. A so-called magnet roll (not shown) of a fixed type is arranged in the magnetic roller 82. The magnetic roller has a plurality of magnetic poles, i.e. a draw-up pole 821, a restricting pole 822 and a main pole 823 in this embodiment. The draw-up pole 821 faces the developer storing unit 81, the restricting pole 822 faces the developer restricting blade 84 and the main pole 823 faces the developing roller 83. Further, the magnetic roller 82 is rotated in a direction opposite to the rotating direction of the developing roller 83 at a facing position (counter rotation) at a speed to provide a circumferential speed ratio of 1.5 with respect to the developing roller 83.

The magnetic roller 82 magnetically draws up (receives) the developer from the developer storing unit 81 onto a circumferential surface 82A thereof by a magnetic force of the draw-up pole 821. The magnetic roller 82 magnetically carries the developer drawn up on the circumferential surface 82A as a developer layer (magnetic brush layer). With the rotation of the magnetic roller 82, the developer is conveyed toward the developer restricting blade 84.

The developer restricting blade 84 is arranged upstream of the developing roller 83 in the rotating direction of the magnetic roller 82 and restricts a layer thickness of the developer layer magnetically adhering to the circumferential surface 82A of the magnetic roller 82. The developer restricting blade 84 is a plate member made of a magnetic material and extending in a longitudinal direction of the magnetic roller 82, and supported by a predetermined supporting member 841 fixed at a suitable position of the development housing 80. Further, the developer restricting blade 84 has a restricting surface 842 (i.e. tip surface of the developer restricting blade 84) forming a restriction gap G of a predetermined dimension between the restricting surface 842 and the circumferential surface 82A of the magnetic roller 82.

The developer restricting blade 84 made of the magnetic material is magnetized by the restricting pole 822 of the magnetic roller 82. In this way, a magnetic path is formed between the restricting surface 842 of the developer restricting blade 84 and the restricting pole 822, i.e. in the restriction gap G. When the developer layer adhering onto the circumferential surface 82A of the magnetic roller 82 by the draw-up pole 821 is conveyed into the restriction gap G with the rotation of the magnetic roller 82, the layer thickness of the developer layer is restricted in the restriction gap G. In this way, the developer layer having a uniform predetermined thickness is formed on the circumferential surface 82A.

The developing roller 83 is arranged to extend along the longitudinal direction of the developing device 122 and in parallel to the magnetic roller 82 and driven to rotate in a clockwise direction in FIG. 2. The developing roller 83 has a circumferential surface 83A for carrying a toner layer by receiving the toner from the developer layer while rotating in a state held in contact with the developer layer carried on the circumferential surface 82A of the magnetic roller 82. At the time of development in which a developing operation is performed, the developing roller 83 supplies the toner of the toner layer to the circumferential surface of the photoconductive drum 121. In this embodiment, the developing roller 83 is a roller obtained by applying resin coating (urethane coating) to a surface of alumite. Further, the developing roller 83 is rotated in the same direction as the photoconductive drum 121 (with rotation) at a facing position at a speed to provide a circumferential speed ratio of 1.3 with respect to the photoconductive drum 121.

The developing roller 83 and the magnetic roller 82 are driven to rotate by a driving unit 962 to be described later. A clearance S of a predetermined dimension is formed between the circumferential surface 83A of the developing roller 83 and the circumferential surface 82A of the magnetic roller 82. The clearance S is, for example, set at 0.3 mm. The developing roller 83 is arranged to face the photoconductive drum 121 through an opening formed on the development housing 80, and a clearance of a predetermined dimension is also formed between the circumferential surface 83A and the circumferential surface of the photoconductive drum 121. In this embodiment, this clearance is set at 0.12 mm.

<Electrical Configuration, Block Diagram>

Figure 4:
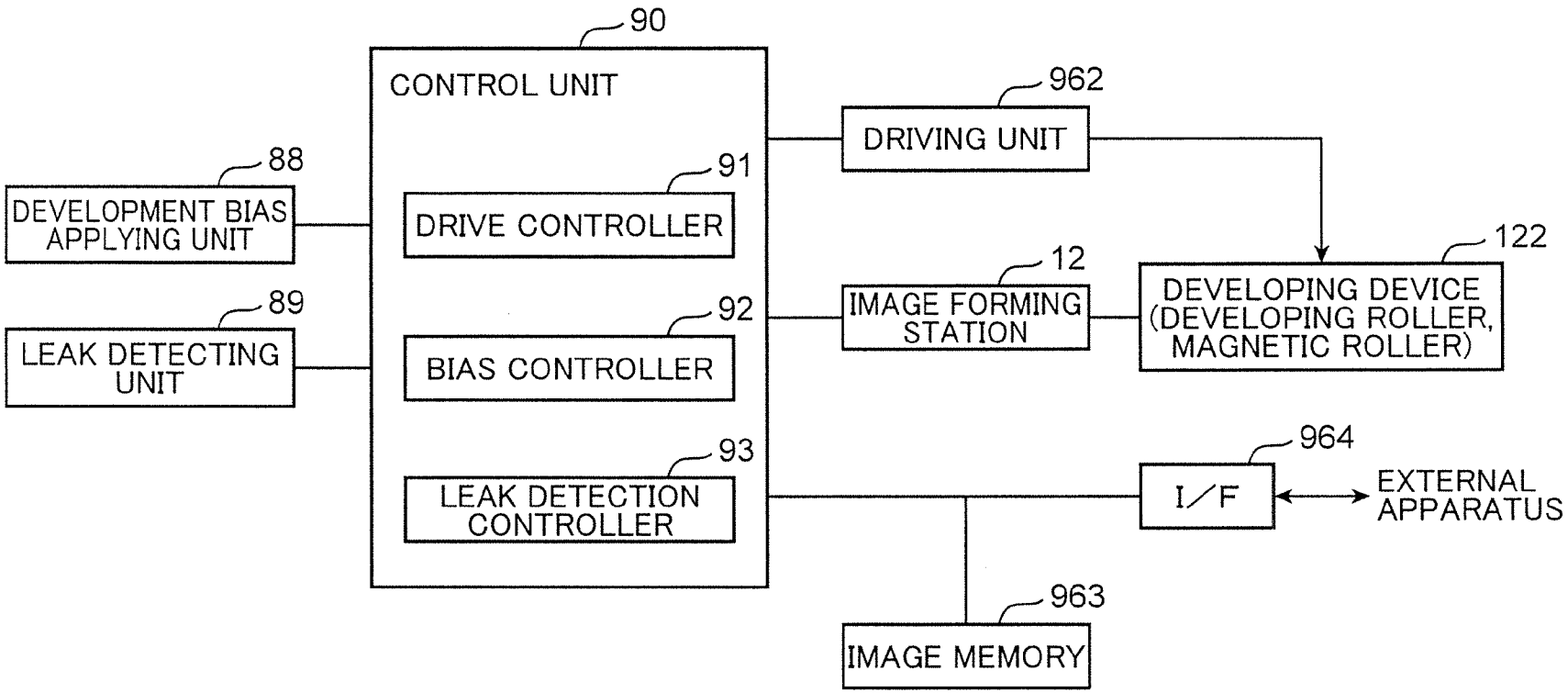
FIG. 4 is a block diagram showing the electrical configuration of a control unit according to the embodiment of the present disclosure.
Figure 5:
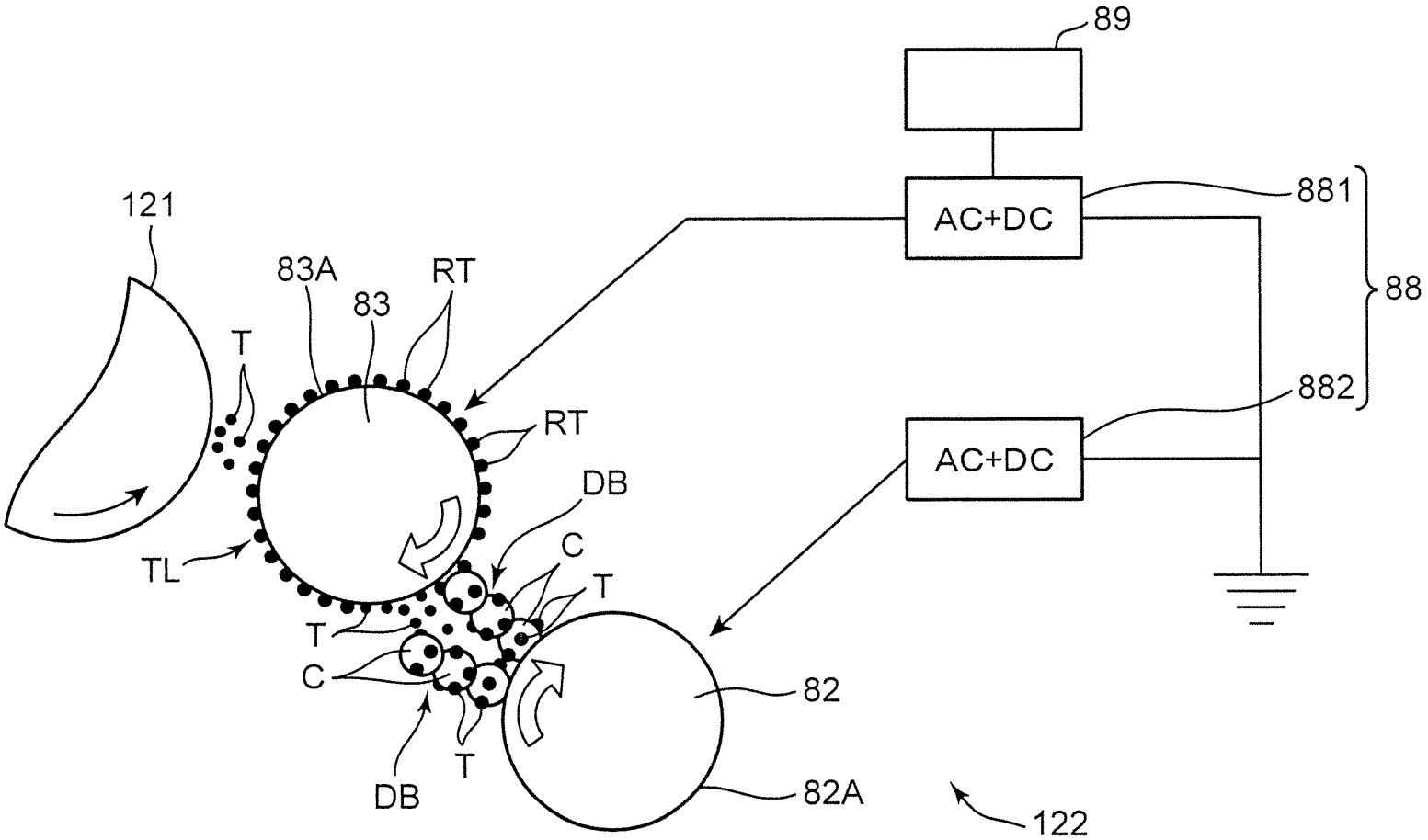
FIG. 5 is a diagram showing a developing operation of the developing device according to the embodiment of the present disclosure.

Next, a main electrical configuration of the image forming apparatus 1 is described. The image forming apparatus 1 (developing device 122) includes a control unit 90 for centrally controlling the operation of each unit of this image forming apparatus 1. FIG. 4 is a functional block diagram of the control unit 90. Further, FIG. 5 is a diagram showing a developing operation of the developing device 122 according to this embodiment. The control unit 90 is composed of a CPU (Central Processing Unit), a ROM (Read Only Memory) storing a control program, a RAM (Random Access Memory) used as a work area of the CPU and the like. Further, besides each member of the developing devices 122, a development bias applying unit 88, a leak detecting unit 89, the driving unit 962, an image memory 963, an I/F 964 and the like are electrically connected to the control unit 90.

Further, with reference to FIG. 5, the development bias applying unit 88 includes a first applying unit 881 and a second applying unit 882. These applying units are composed of a direct current power supply and an alternating current power supply, and apply development biases, in which an alternating current voltage is superimposed on a direct current voltage, to the magnetic roller 82 and the developing roller 83 in the developing device 122 based on a control signal from a bias connector 92 or a leak detection controller 93. In this embodiment, the first applying unit 881 is electrically connected to the developing roller 83. Further, the second applying unit 882 is electrically connected to the magnetic roller 82.

The leak detecting unit 89 is electrically connected to the development bias applying unit 88. The leak detecting unit 89 detects a leak generated between the photoconductive drum 121 and the developing roller 83 or a leak generated between the developing roller 83 and the magnetic roller 82. Specifically, the leak detecting unit 89 detects the leak based on a variation of the value of a current (overcurrent) flowing into the developing roller 83.

The driving unit 962 (FIG. 4) is composed of a motor and a gear mechanism for transmitting a torque of the motor, and drives and rotates the developing roller 83, the magnetic roller 82, the screw feeders 85, 86 and the like in the developing device 122 in addition to the photoconductive drum 121 during a developing operation and a leak detecting operation in response to a control signal from the control unit 90. In this embodiment, the developing roller 83, the magnetic roller 82 and the screw feeders 85, 86 are synchronously driven to rotate by the driving unit 962.

The image memory 963 temporarily stores, for example, print image data given from an external apparatus such as a personal computer when this image forming apparatus 1 functions as a printer. Further, the image memory 963 temporarily stores image data optically read by an ADF 20 when the image forming apparatus 1 functions as a copier.

The I/F 964 is an interface circuit for realizing data communication with external apparatuses and, for example, generates a communication signal in conformity with a communication protocol of a network for connecting the image forming apparatus 1 and an external apparatus and converts a communication signal from the network side into data of a format processable by the image forming apparatus 1. A print instruction signal transmitted from a personal computer or the like is given to the control unit 90 via the I/F 964 and image data is stored in the image memory 963 via the I/F 964.

The control unit 90 functions to include a drive controller 91, the bias controller 92 and the leak detection controller 93 by the CPU executing the control program stored in the ROM.

The drive controller 91 drives and rotates the developing roller 83, the magnetic roller 82 and the screw feeders 85, 86 by controlling the driving unit 962. Further, the drive controller 91 drives and rotates the photoconductive drum 121 by controlling the unillustrated driving mechanism. In this embodiment, the drive controller 91 drives and rotates each of the above members in the developing operation and the leak detecting operation.

The bias controller 92 provides a potential difference in the direct current voltage between the magnetic roller 82 and the developing roller 83 by controlling the development bias applying unit 88 during the developing operation in which the toner is supplied from the magnetic roller 82 to the developing roller 83 and further from the developing roller 83 to the photoconductive drum 121. The toner is transferred from the magnetic roller 82 to the developing roller 83 due to this potential difference. The development bias during the developing operation is described in detail later.

The leak detection controller 93 applies direct current voltages and alternating current voltages to the magnetic roller 82 and the developing roller 83 by controlling the development bias applying unit 88 in the leak detecting operation. In the leak detecting operation, an inter-peak voltage of the alternating current voltage at which the leak is generated is detected out of the development bias applied to the developing roller 83. At this time, the leak detection controller 93 generates a leak between the photoconductive drum 121 and the developing roller 83 or between the magnetic roller 82 and the developing roller 83 while increasing the inter-peak voltage of the alternating current voltage of the development bias. The leak detecting operation is performed prior to the developing operation, i.e. at a time different from that during the developing operation, and the inter-peak voltage (leak generating voltage) at which a leak is generated is detected. As a result, during the developing operation, the inter-peak voltage of the alternating current voltage is set in such a range as not to reach the leak generating voltage and the occurrence of a leak is prevented. Note that the development bias during the leak detecting operation is described in detail later.

<Concerning Developing Operation>

Next, a mechanism for developing an electrostatic latent image on the photoconductive drum 121 during the developing operation is described with reference to FIG. 5. The image forming apparatus 1 according to this embodiment has a print speed of 25/min. A circumferential speed of the photoconductive drum 121 is set at 120 mm/sec. Further, in this embodiment, coating ferrite carrier having a volume specific resistance of 1.0E+10 Ω·cm, a saturation magnetization of 65 emu/g and an average particle diameter of 35 μm is used as the carrier in the developer.

The magnetic brush layer on the circumferential surface 82A of the magnetic roller 82 is conveyed toward the developing roller 83 with the rotation of the magnetic roller 82 after the layer thickness thereof is uniformly restricted by the developer restricting blade 84. Thereafter, a multitude of magnetic bristles DB in the magnetic brush layer come into contact with the circumferential surface 83A of the developing roller 83 in rotation in an area where the magnetic roller 82 and the developing roller 83 face each other.

At this time, the bias controller 92 applies the development biases composed of the direct current voltage and the alternating current voltage to the magnetic roller 82 and the developing roller 83 as described later by controlling the development bias applying unit 88. This causes a predetermined potential difference (development potential difference ΔV) to be generated between the circumferential surface 82A of the magnetic roller 82 and the circumferential surface 83A of the developing roller 83. The development potential difference ΔV is set in a range of 100 V to 350 V according to an environment or the like. Due to this potential difference, only toner T moves from the magnetic bristles DB to the circumferential surface 83A at a position of the circumferential surface 82A (main pole 823 (FIG. 2)) facing the circumferential surface 83A, and carrier C of the magnetic bristles DB and a part of the toner remain on the circumferential surface 82A. In this way, a toner layer TL having a predetermined thickness is carried on the circumferential surface 83A of the developing roller 83.

The toner layer TL on the circumferential surface 83A is conveyed toward the circumferential surface of the photoconductive drum 121 with the rotation of the developing roller 83. A superimposed voltage of a direct current voltage and an alternating current voltage is applied to the developing roller 83. Thus, a predetermined potential difference is produced between the circumferential surface of the photoconductive drum 121 having a potential according to an electrostatic latent image and the circumferential surface 83A of the developing roller 83. Due to this potential difference, the toner T of the toner layer TL moves to the circumferential surface of the photoconductive drum 121. In this way, the electrostatic latent image on the circumferential surface of the photoconductive drum 121 is developed to form a toner image.

Note that examples of the development biases applied to the magnetic roller 82 and the developing roller 83 by the bias controller 92 controlling the development bias applying unit 88 during the developing operation are as follows.

Direct current voltage Vmag_dc of magnetic roller 82: 450 V

Direct current voltage Vslv_dc of developing roller 83: 250 V

Alternating current voltage (Vpp) Vmag_ac of magnetic roller 82: 1800 V (3.7 kHz)

Alternating current voltage (Vpp) Vslv_ac of developing roller 83: 700 V (3.7 kHz)

Duty ratio (Duty 1) of alternating current voltage of developing roller 83: 27%

Duty ratio (Duty 2) of alternating current voltage of magnetic roller 82: 73%

Image part potential VL of photoconductive drum 121: +100 V

Background part potential Vo of photoconductive drum 121: +430 V

The alternating current voltages out of the development biases applied to the magnetic roller 82 and the developing roller 83 are opposite to each other while having the same phase. Thus, in addition to the aforementioned development potential difference ΔV composed of the direct current voltage, a periodic potential difference based on the alternating current voltage is set between the magnetic roller 82 and the developing roller 83. As a result, the movement of the toner from the magnetic roller 82 to the developing roller 83 is promoted.

Further, in such a developing device 122, specific development biases can be applied to the magnetic roller 82 and the developing roller 83 respectively when the leak generating voltage at which a leak is generated between the photoconductive drum 121 and the developing roller 83 or between the magnetic roller 82 and the developing roller 83 is detected by the leak detecting unit 89. Thus, it is possible to suppress the movement of the toner from the magnetic roller 82 to the developing roller 83 during the leak detecting operation and perform the leak detecting operation in a state where the surface of the developing roller 83 is exposed as much as possible.

The leak detection controller 93 (FIG. 4) performs the leak detecting operation at timings such as that when the image forming apparatus 1 is shipped from a factor and that when the developing device 122 or the photoconductive drum 121 is exchanged in the image forming apparatus 1. Further, the leak detection controller 93 performs the leak detecting operation also at a timing such as that when a surrounding environment (temperature, humidity) of the image forming apparatus 1 varies or that when a printing operation is performed a predetermined number of times. In such a leak detecting operation, the leak detection controller 93 drives and rotates the photoconductive drum 121 and each member of the developing device 122 by controlling the drive controller 91. Further, the leak detection controller 93 forms an electrostatic latent image on the photoconductive drum 121 by controlling the charging device 123 and the exposure device 124. Then, the leak detection controller 93 detects the inter-peak voltage at which a leak is generated by detecting an overcurrent by the leak detecting unit 89 while increasing the inter-peak voltage of the alternating current voltage applied to the developing roller 83.

Examples of the development biases applied to the magnetic roller 82 and the developing roller 83 by the leak detection controller 93 controlling the development bias applying unit 88 during the leak detecting operation are as follows.

Direct current voltage Vmag_dc of magnetic roller 82: 150 V

Direct current voltage Vslv_dc of developing roller 83: 150 V

Alternating current voltage (Vpp) Vmag_ac of magnetic roller 82: variable (2.05 kHz)

Alternating current voltage (Vpp) Vslv_ac of developing roller 83: variable (2.05 kHz)

Duty ratio of alternating current voltage of developing roller 83: 15%

Duty ratio of alternating current voltage of magnetic roller 82: 15%

Image part potential VL of photoconductive drum 121: +100 V

Background part potential Vo of photoconductive drum 121: +430 V

Next, a leak detecting operation according to a first embodiment of the present disclosure is described. TABLE-1 is a table of the inter-peak voltage Vpp of the development bias according to this embodiment. The table represented by TABLE-1 is stored in an unillustrated storage connected to the control unit 90. The above table is referred to by the leak detection controller 93 when the leak detecting operation is performed. Values of different inter-peak voltages from the first to the fifth columns are stored in each of rows A to V of TABLE-1.

TABLE 1

| | Developing roller inter-peak voltage (Vpp: V) | | | | |
|---|---|---|---|---|---|
| | 1 | 2 | 3 | 4 | 5 |
| A | 800 | 810 | 820 | 830 | 840 |
| B | 850 | 860 | 870 | 880 | 890 |
| C | 900 | 910 | 920 | 930 | 940 |
| D | 950 | 960 | 970 | 980 | 990 |
| E | 1000 | 1010 | 1020 | 1030 | 1040 |
| F | 1050 | 1060 | 1070 | 1080 | 1090 |
| G | 1100 | 1110 | 1120 | 1130 | 1140 |
| H | 1150 | 1160 | 1170 | 1180 | 1190 |
| I | 1200 | 1210 | 1220 | 1230 | 1240 |
| J | 1250 | 1260 | 1270 | 1280 | 1290 |
| K | 1300 | 1310 | 1320 | 1330 | 1340 |

TABLE 1-continued

| | Developing roller inter-peak voltage (Vpp: V) | | | | |
|---|---|---|---|---|---|
| | 1 | 2 | 3 | 4 | 5 |
| L | 1350 | 1360 | 1370 | 1380 | 1390 |
| M | 1400 | 1410 | 1420 | 1430 | 1440 |
| N | 1450 | 1460 | 1470 | 1480 | 1490 |
| O | 1500 | 1510 | 1520 | 1530 | 1540 |
| P | 1550 | 1560 | 1570 | 1580 | 1590 |
| Q | 1600 | 1610 | 1620 | 1630 | 1640 |
| R | 1650 | 1660 | 1670 | 1680 | 1690 |
| S | 1700 | 1710 | 1720 | 1730 | 1740 |
| T | 1750 | 1760 | 1770 | 1780 | 1790 |
| U | 1800 | 1810 | 1820 | 1830 | 1840 |
| V | 1850 | 1860 | 1870 | 1880 | 1890 |

Figure 6:
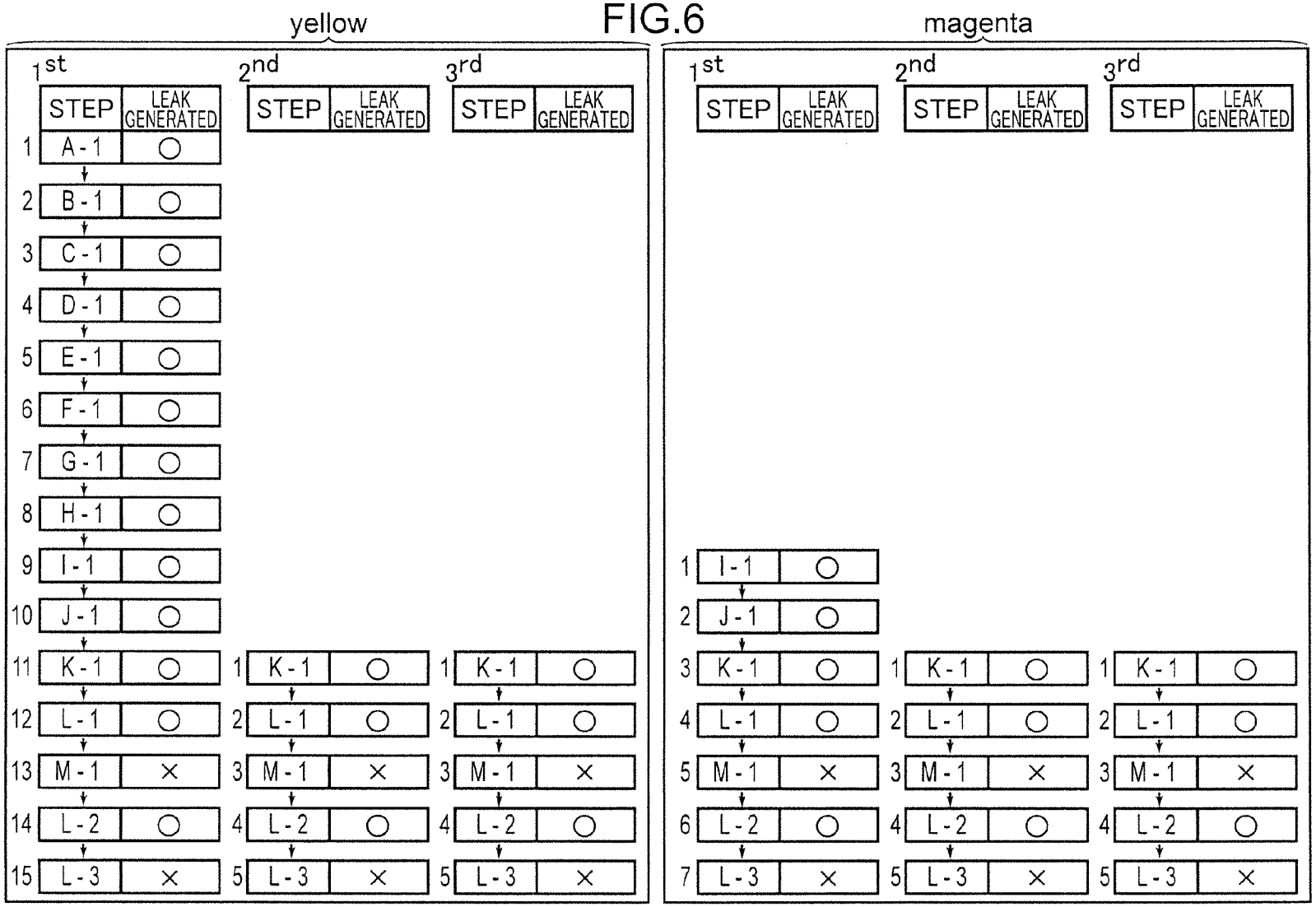
FIG. 6 is a diagram showing steps of a leak detecting operation according to a first embodiment of the present disclosure.
Figure 7:
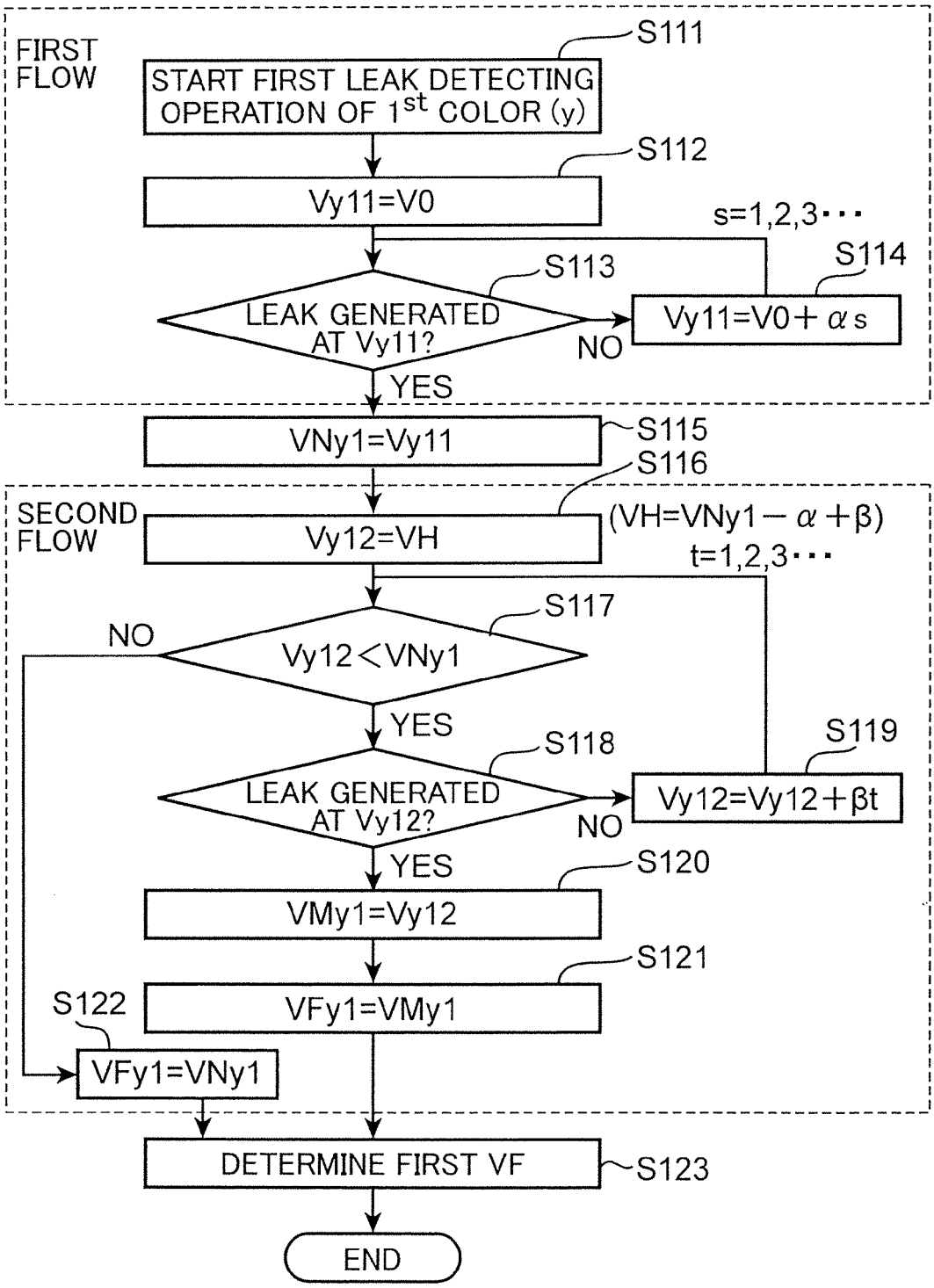
FIG. 7 is a flow chart showing a part of the leak detecting operation according to the first embodiment of the present disclosure.
Figure 8:
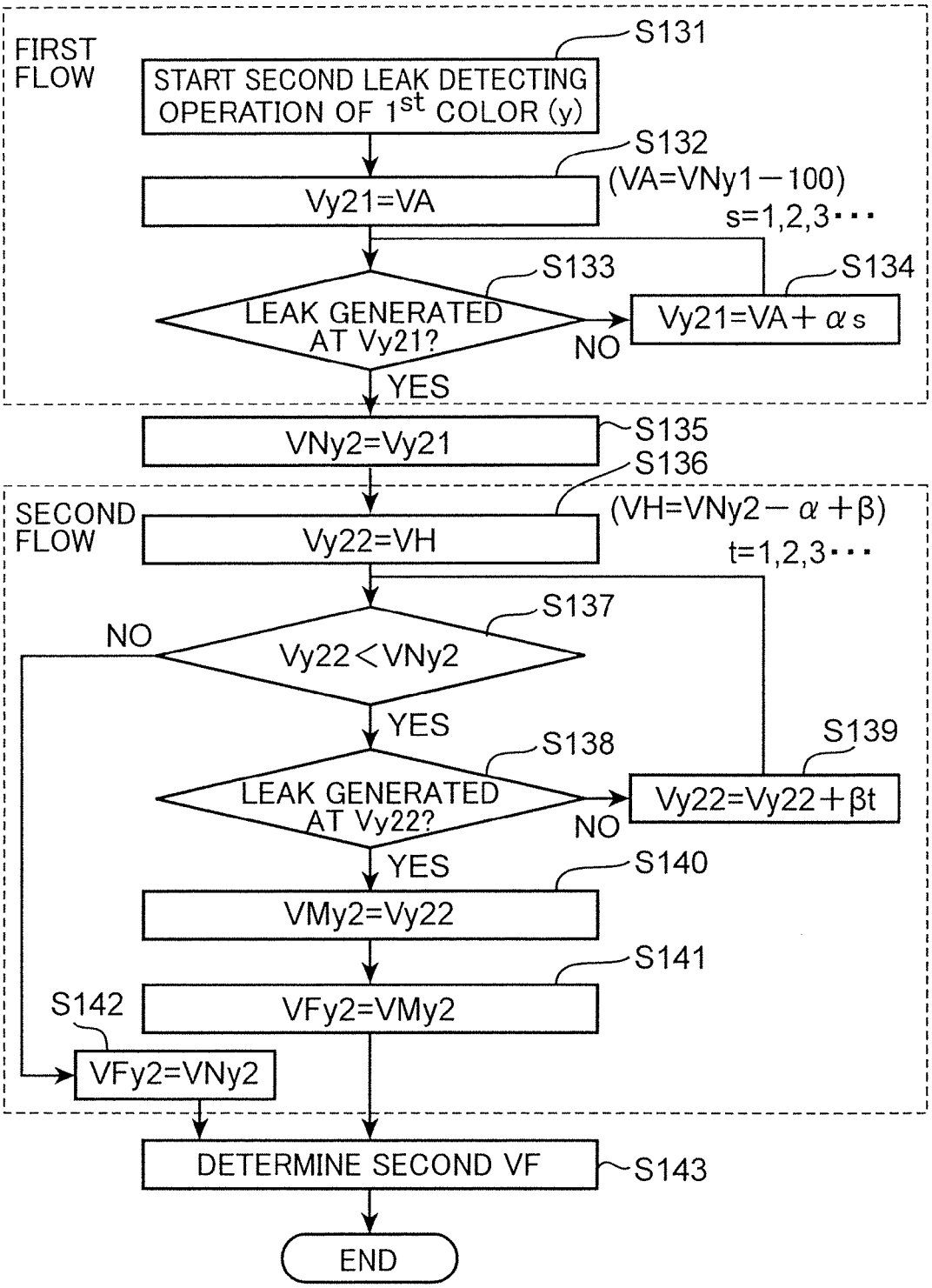
FIG. 8 is a flow chart showing a part of the leak detecting operation according to the first embodiment of the present disclosure.
Figure 9:
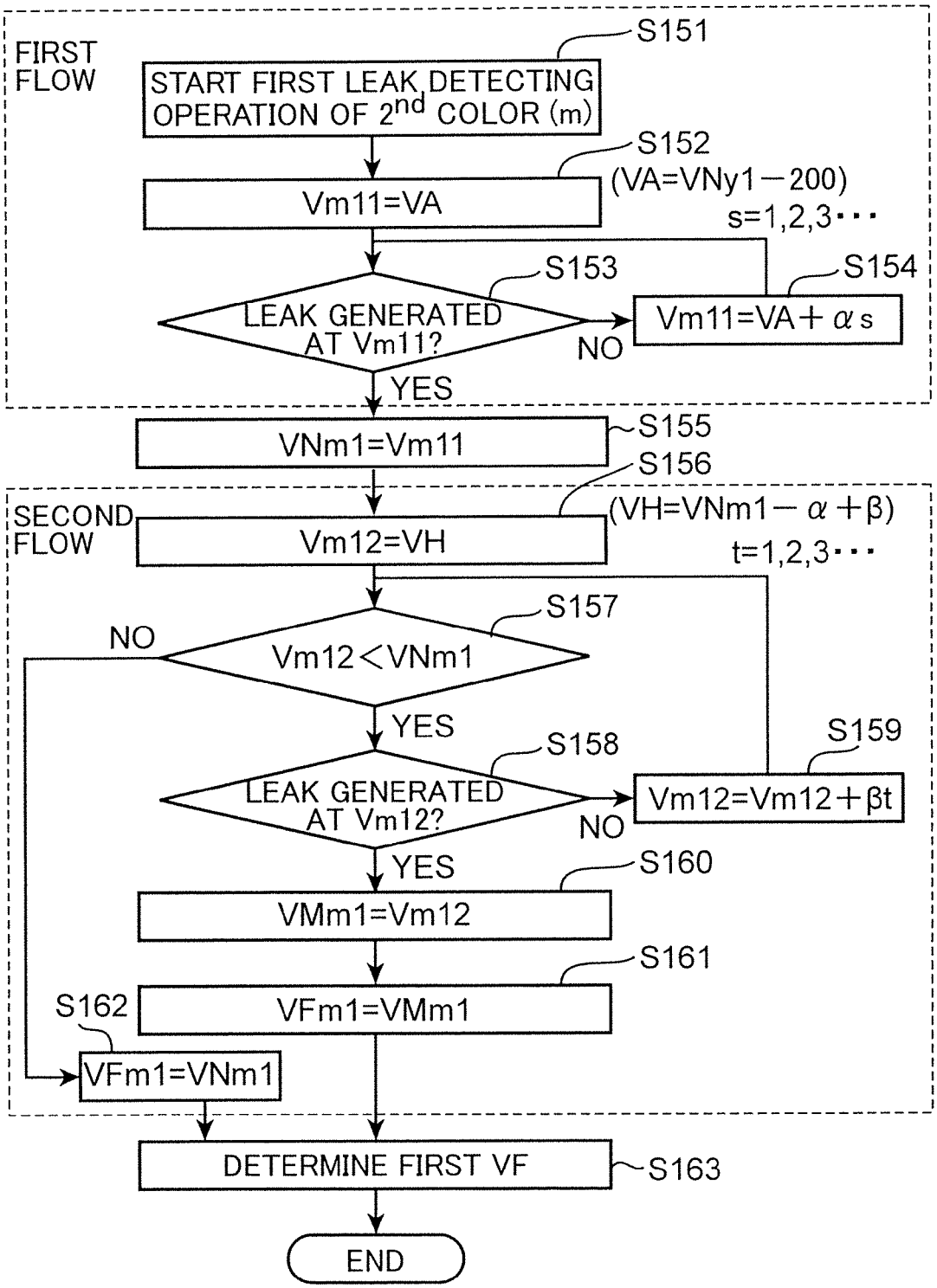
FIG. 9 is a flow chart showing a part of the leak detecting operation according to the first embodiment of the present disclosure.

Further, FIG. 6 is a diagram showing steps of the leak detecting operation according to this embodiment. FIGS. 7 to 9 are flow chart showing parts of the leak detecting operation according to this embodiment.

The leak detection controller 93 successively performs a plurality of leak detecting operations at predetermined timings as described above. FIG. 6 shows each step of six leak detecting operations successively performed by the leak detection controller 93. At this time, in this embodiment, the first to third leak detecting operations from the left are leak detecting operations in the yellow developing device 122, and the fourth to sixth leak detecting operations are leak detecting operations in the magenta developing device 122. Specifically, the plurality of leak detecting operations in this embodiment include those repeatedly performed for the same developing device and those successively performed for different developing devices.

In this embodiment, the leak detection controller 93 increases the inter-peak voltage from a reference detection starting voltage V0 set in advance and detects the inter-peak voltage when a leak is detected as a leak generating voltage VF in the first one of the plurality of leak detecting operations.

With reference to FIGS. 6 and 7, a flow of the first leak detecting operation in the yellow developing device 122 is described in detail. The leak detection controller 93 has a first flow having relatively rough detection accuracy and performed in a short time, and a second flow having high detection accuracy (FIG. 7). When starting the leak detecting operation of the yellow developing device 122 (S111 of FIG. 7), the leak detection controller 93 refers to the inter-peak voltage of 800 V in a cell of row A and 1st column shown in TABLE-1 (hereinafter, A-1 of TABLE-1) and starts the leak detecting operation from Vy11=800 V (S112 of FIG. 7). Note that the inter-peak voltage in A-1 of TABLE-1 is defined as the reference detection starting voltage V0. The reference detection starting voltage V0 is a minimum value of the inter-peak voltage shown in TABLE-1 and set at a value which is about half the inter-peak voltage, at which a leak is averagely generated at the developing roller 83, in advance when the image forming apparatus 1 is installed on a standard flatland (not highland). Note that, by setting the reference detection starting voltage V0 to be somewhat low in this way, the leak detecting operation is stably performed even if the image forming apparatus 1 is installed on a highland and a leak is easily generated due to a low atmospheric pressure. Note that, out of symbols of the inter-peak voltage Vy11 shown in FIG. 7, "y" denotes yellow color and subsequent "I" means the first leak detecting operation of yellow color. The next "1" means the first flow until a first leak generating voltage VN to be described later is derived. The same holds also for symbols described below.

The leak detection controller 93 applies the inter-peak voltage Vy11 to the developing roller 83 and causes the leak detecting unit 89 to detect the occurrence of a leak (S113 of FIG. 7). If no leak is generated (NO in S113), the leak detection controller 93 sets a value obtained by adding $\alpha \times s$ to the reference detection starting voltage V0 as a new inter-peak voltage Vy11 (Step 114). Here, a is a first potential interval set in advance and set at 50 V in this embodiment. Note that s is a natural number and incremented by 1 every time Step S114 is repeated. The leak detection controller 93 repeats Steps S113 and S114 while increasing s until a leak is generated at the updated inter-peak voltage Vy11.

Then, when a leak is generated at the inter-peak voltage Vy11 (YES in Step S113), the leak detection controller 93 stores the inter-peak voltage Vy11 at that time as the first leak generating voltage VN in the storage (Step S115). Note that, in FIG. 7, the first leak generating voltage VN is denoted by VNy1 (first leak generating voltage VN in the first leak detecting operation of yellow color). On the other hand, in FIG. 6, a flow until the above first leak generating voltage VNy1 is detected is shown in steps from A-1 to M-1 of the first leak detecting operation of yellow color. In other words, with reference to M-1 of TABLE-1, the first leak generating voltage VNy1=1400 V in this embodiment.

As just described, in this embodiment, the leak detection controller 93 increases the inter-peak voltage at the first potential interval $\alpha$ from the reference detection starting voltage V0 and detects the inter-peak voltage when the leak is first detected as the first leak generating voltage VN as the first flow of the leak detecting operation.

Further, with reference to FIG. 7, the leak detection controller 93 adopts a supplementary detection starting voltage VH as a first inter-peak voltage Vy12 of the second flow (Step S116). Note that, out of symbols of the inter-peak voltage Vy12 shown in FIG. 7, "y" denotes yellow color and subsequent "1" means the first leak detecting operation of yellow color. The next "2" means the second flow until a second leak generating voltage VM to be described later is derived. The same holds also for symbols described below. Here, the supplementary detection starting voltage VH is calculated by $VH=VNy1-\alpha+\beta$. Note that $\beta$ is a second potential interval set in advance and set at 10 V in this embodiment. Thus, the supplementary detection starting voltage VH is 1360 V and shown in step L-2 of the first leak detecting operation of yellow color in FIG. 6.

Subsequently, the leak detecting operation 93 determines whether or not the first inter-peak voltage Vy12, for which the supplementary detection starting voltage VH is adopted, is lower than the aforementioned first leak generating voltage VNy1 (Step S117). Since $Vy12<VNy1$ holds when the second flow is started (YES in Step S117), the leak detection controller 93 causes the leak detecting unit 89 to detect whether or not a leak is generated at the inter-peak voltage Vy12 (Step S118). If no leak is generated (NO in Step S118), the leak detection controller 93 sets a value obtained by adding $\beta \times t$ to the inter-peak voltage Vy12 as a new inter-peak voltage Vy12 (Step S119). Note that t is a natural number similarly to s and incremented by 1 every time Step S119 is repeated.

The leak detection controller 93 repeats Steps S117, S118 and S119 while increasing t until a leak is generated at the updated inter-peak voltage Vy12. When a leak is generated at the inter-peak voltage Vy12 (YES in Step S118), the leak detection controller 93 stores the inter-peak voltage Vy12 at that time as the second leak generating voltage VM in the storage. Note that, in FIG. 7, the second leak generating voltage VM is denoted by VMy1. A symbol "y1" at this time denotes the first leak detecting operation of yellow color. Further, a flow until the second leak generating voltage VMy1 is detected is shown from Steps L-2 to L-3 of the first leak detecting operation of yellow color in FIG. 6. In other words, with reference to L-3 of TABLE-1, the second leak generating voltage VMy1=1370 V in this embodiment.

Further, the leak detection controller 93 stores the detected second leak generating voltage VMy1 as the final leak generating voltage VF in the first leak detecting operation of yellow color in the storage (Step S121). Note that if the updated inter-peak voltage VNy12 exceeds the first leak generating voltage VNy1 as a result of repeating Step S119 (No in Step S117), the leak detection controller 93 stores the first leak generating voltage VNy1 as the final leak generating voltage VF in the first leak detecting operation of yellow color in the storage (Step S122). This is to set the minimum inter-peak voltage, at which a leak was generated, as the leak generating voltage VF in the first and second flows. In this way, the leak generating voltage VF in the first leak detecting operation of yellow color is determined (Step S123).

As just described, in this embodiment, the leak detection controller 93 increases the inter-peak voltage at the second potential interval β smaller than the first potential interval α from the supplementary detection starting voltage VH (third detection starting voltage) lower than the first leak generating voltage VNy1 by the first potential interval α until the first leak generating voltage VNy1 is reached and detects the inter-peak voltage when a leak is detected again as the second leak generating voltage VMy1 as the second flow of the leak detecting operation. Then, the leak detection controller 93 sets the detected first or second leak generating voltage VNy1 or VMy1 as the leak generating voltage VF in this leak detecting operation. According to this configuration, the leak detection is performed at a relatively rough potential interval up to the first leak generating voltage VNy1. Further, the leak detection is performed at a relatively fine potential interval up to the second leak generating voltage VMy1. Thus, the leak detection can be performed with high accuracy while reducing the number of steps required for the leak detecting operation.

Next, the second leak detecting operation of yellow color is described with reference to FIGS. 6 and 8. In the second or subsequent leak detecting operation, the leak detection controller 93 increases the inter-peak voltage from a first detection starting voltage VA calculated according to the already detected leak generating voltage VF and detects an inter-peak voltage when a leak is detected as the next leak generating voltage VF.

With reference to FIG. 8, when the second leak detecting operation of the developing device 122 of yellow color is started (Step S131 in FIG. 8), the leak detection controller 93 adopts the first detection starting voltage VA as a first inter-peak voltage Vy21 of the first flow. Here, the first detection starting voltage VA is calculated by VA=VNy1−100 (V). 100V in this equation is defined as a first potential difference. As described above, the first leak generating voltage VNy1 detected in the first leak detecting operation was 1400 V. Thus, the first detection starting voltage VA is 1400−100=1300 V and shown in step K-1 of the second leak detecting operation of yellow color in TABLE-1 and FIG. 6.

As just described, in this embodiment, the second leak detecting operation is started from the first detection starting voltage VA higher than the reference detection starting voltage V0, whereby the number of steps required for the second leak detecting operation can be reduced. On the other hand, by starting the leak detecting operation from the first detection starting voltage VA lower than the first leak generating voltage VNy1, at which a leak was detected in the first leak detecting operation, by 100 V, the leak detecting operation can be accurately performed even if the leak generating voltage VF varies. Note that, as described later, the second leak detecting operation may be started from the first detection starting voltage VA lower than the second leak generating voltage VMy1 (leak generating voltage VF) detected in the first leak detecting operation by a predetermined first potential difference in another modification.

Note that, in FIG. 8, a flow from Step S133 to Step S143 is similar to that from Step S113 to Step S123 of FIG. 7. In Step S143 of FIG. 8, the leak generating voltage VF in the second leak detecting operation of yellow color is determined.

Further, as shown in FIG. 6, a third leak detecting operation of yellow color may be similarly performed, following the second leak detecting operation. Then, the leak detection controller 93 sets an inter-peak voltage applied to the developing roller 83 of yellow color during the developing operation based on an average value or a minimum value of a plurality of leak generating voltages VF obtained by a plurality of these leak detecting operations of yellow color. Specifically, considering a predetermined safety factor, an inter-peak voltage lower than the average value or the minimum value of the plurality of leak generating voltages VF by a predetermined value is set as the inter-peak voltage applied during the developing operation. As a result, the occurrence of a leak during the developing operation in which an image is formed in the image forming apparatus 1 is suppressed and an image defect of a toner image on the photoconductive drum 121 is prevented.

Next, a first leak detecting operation of magenta color according to this embodiment is described with reference to FIGS. 6 and 9. As described above, as shown in FIG. 6, the leak detecting operation of magenta color is successively started after the leak detecting operation of yellow color is finished. In this embodiment, the leak detection controller 93 increases the inter-peak voltage from the first detection starting voltage VA calculated according to the already detected leak generating voltage VF in the leak detecting operation of yellow color and detects an inter-peak voltage when a leak is detected as a leak generating voltage VF of magenta color in the first leak detecting operation of magenta color.

With reference to FIG. 9, when the first leak detecting operation of magenta color is started (Step S151 in FIG. 9), the leak detection controller 93 adopts the first detection starting voltage VA as a first inter-peak voltage Vm11 of the first flow. Here, the first detection starting voltage VA is calculated by VA=VNy1-200 (V). 200V in this equation is defined as a first potential difference similar to 100 V of Step S132 of FIG. 8. As described above, the first leak generating voltage VNy1 detected in the first leak detecting operation of yellow color was 1400 V. Thus, the first detection starting voltage VA of the first leak detecting operation of magenta color is 1400−200=1200 V and shown in step I-1 of the first leak detecting operation of magenta color.

As just described, in this embodiment, the first leak detecting operation of magenta color is started from the first detection starting voltage VA higher than the reference detection starting voltage V0, whereby the number of steps required for the first leak detecting operation of magenta color can be reduced. On the other hand, by starting the leak detecting operation of magenta color from the first detection starting voltage VA lower than the first leak generating voltage VNy1, at which the leak was detected in the first leak detecting operation of yellow color, by 200 V, the leak detecting operation can be accurately performed even if the leak generating voltage VF varies. Particularly, since a gap between the photoconductive drum 121 and the developing roller 83 varies among different developing devices, the leak generating voltage VF tends to vary more than when the leak detecting operation is repeated in the same developing device. In this embodiment, as described above, a plurality of leak detecting operations performed by the leak detection controller 93 include a first leak detecting operation group (first and second leak detecting operations of yellow color) repeatedly performed for the same developing device and a second leak detecting operation group (second leak detecting operation of yellow color and first leak detecting operation of magenta color) successively performed for different developing devices. The first potential difference in the second leak detecting operation group (200 V) is set higher than that in the first leak detecting operation group (100 V). Thus, the leak detecting operations can accurately be performed even if the leak generating voltage VF particularly varies among the different developing devices. Note that, in another modification, the first leak detecting operation of magenta color may be started from the first detection starting voltage VA lower than the second leak generating voltage VMy1 (leak generating voltage VF), at which the leak was detected in the first leak detecting operation of yellow color, by a predetermined first potential difference.

Note that, in FIG. 9, a flow from Step S153 to Step S163 is similar to that from Step S113 to Step S123 of FIG. 7. In Step S163 of FIG. 9, the leak generating voltage VF in the first leak detecting operation of magenta color is determined.

Thereafter, as shown in FIG. 6, second and third leak detecting operations of magenta color may be successively and similarly performed. Then, the leak detection controller 93 sets an inter-peak voltage applied to the developing roller 83 of magenta color during the developing operation based on an average value or a minimum value of a plurality of leak generating voltages VF obtained by a plurality of these leak detecting operations of magenta color. In other words, in the image forming apparatus 1, a plurality of leak detecting operations are performed a plurality of times for each developing device 122. Then, the inter-peak voltage applied to the developing roller 83 during the developing operation of each developing device 122 is set based on the average value or the minimum value of the plurality of leak generating voltages VF obtained by the plurality of leak detecting operations in each developing device 122.

TABLE-2 is a table showing the numbers of steps of the leak detecting operations according to this embodiment.

TABLE 2

| | | Steps |
|---|---|---|
| Total Step 1 | | |
| $1^{st}$ Color | $1^{st}$ | 15 |
| | $2^{nd}$ | 15 |
| | $3^{rd}$ | 15 |
| $2^{nd}$ Color | $1^{st}$ | 15 |
| | $2^{nd}$ | 15 |
| | $3^{rd}$ | 15 |
| $3^{rd}$ Color | $1^{st}$ | 15 |
| | $2^{nd}$ | 15 |
| | $3^{rd}$ | 15 |
| $4^{th}$ Color | $1^{st}$ | 15 |
| | $2^{nd}$ | 15 |
| | $3^{rd}$ | 15 |
| | Total | 180 |

TABLE 2-continued

| | | Steps |
|---|---|---|
| Total Step 2 | | |
| $1^{st}$ Color | $1^{st}$ | 15 |
| | $2^{nd}$ | 5 |
| | $3^{rd}$ | 5 |
| $2^{nd}$ Color | $1^{st}$ | 7 |
| | $2^{nd}$ | 5 |
| | $3^{rd}$ | 5 |
| $3^{rd}$ Color | $1^{st}$ | 7 |
| | $2^{nd}$ | 5 |
| | $3^{rd}$ | 5 |
| $4^{th}$ Color | $1^{st}$ | 7 |
| | $2^{nd}$ | 5 |
| | $3^{rd}$ | 5 |
| | Total | 76 |

With reference to TABLE-2, it is assumed that the same leak detecting operation as the first leak detecting operation (15 steps) of yellow color of FIG. 6 is performed three times in each of the developing devices 122 of four colors in other leak detecting operations to be compared with the leak detecting operations according to this embodiment. In this case, total step 1 is as many as 180 steps as shown in TABLE-1. On the other hand, as shown in FIG. 6, three leak detecting operations of yellow color are respectively completed with 15, 5 and 5 steps in this embodiment. Further, three leak detecting operations of magenta are respectively completed with 7, 5 and 5 steps in this embodiment. Thereafter, the leak detecting operations are completed with the same numbers of steps as in the case of magenta also in the leak detecting operations of cyan color and black color. As a result, as shown in TABLE-2, total step 2 of this embodiment is reduced to 76 steps and the leak detecting operations are completed with the number of steps which is about 40% of total step 1. As just described, in this embodiment, it is possible to shorten a time required for the leak detecting operations while maintaining the accuracy of the leak detecting operations.

Figure 10:
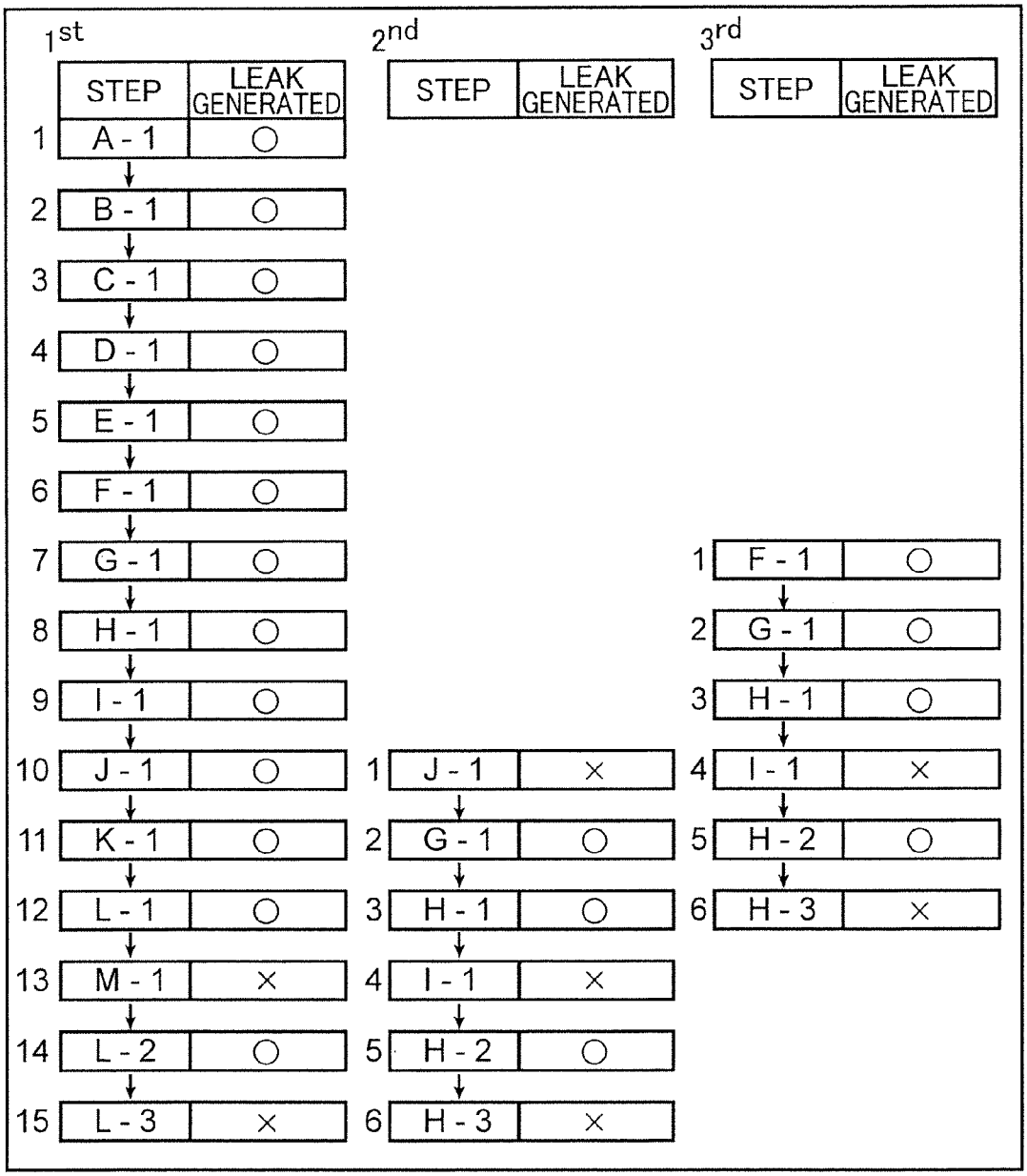
FIG. 10 is a diagram showing steps of a leak detecting operation according to a second embodiment of the present disclosure.
Figure 11:
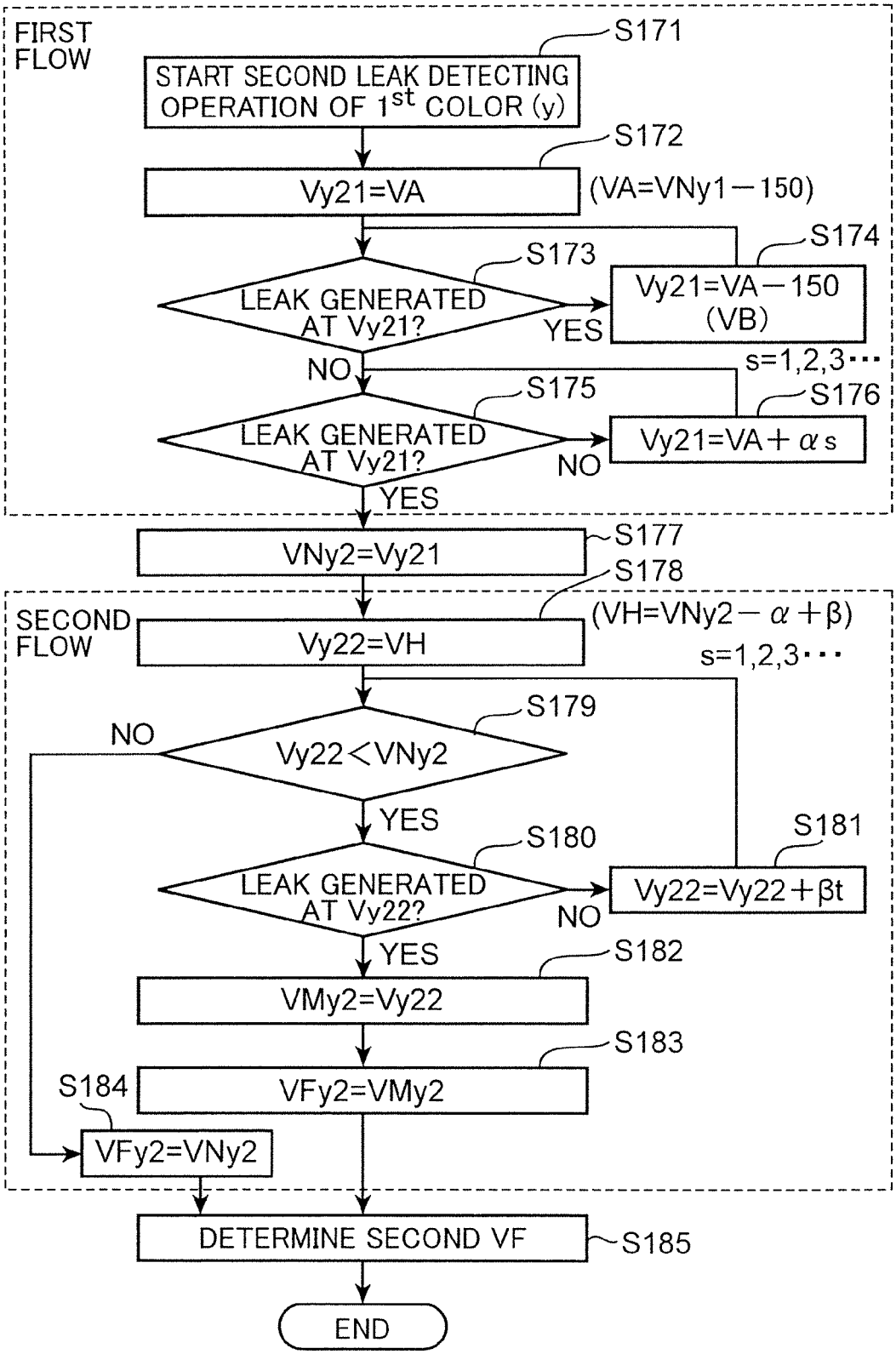
FIG. 11 is a flow chart showing a part of the leak detecting operation according to the second embodiment of the present disclosure.

Next, a second embodiment of the present disclosure is described with reference to FIGS. 10 and 11. FIG. 10 is a diagram showing steps of leak detecting operations according to the second embodiment. FIG. 11 is a flow chart showing a part of the leak detecting operation according to the second embodiment. FIG. 11 corresponds to the flow chart of the second leak detecting operation of yellow color. In the second embodiment, the leak detecting operation of yellow color to be successively performed a plurality of times is described. Note that since the second embodiment differs from the previous first embodiment in a first flow of the second leak detecting operation, description is made, centering on this point of difference and common points are not described.

As in the previous first embodiment, a first leak detecting operation of yellow color is performed as shown in FIGS. 7 and 10. As a result, a first leak generating voltage VNy1 and a second leak generating voltage VMy1 of the first leak detecting operation of yellow color are stored in the storage (Steps S115 and S120 of FIG. 7, M-1 and L-3 of the first leak detecting operation of FIG. 10). Further, the leak generating voltage VF in the first leak detecting operation of yellow color is determined (Step S123 of FIG. 7).

On the other hand, with reference to FIG. 11, the leak detection controller 93 adopts a first detection starting voltage VA as a first inter-peak voltage Vy21 of a first flow in this embodiment when the second leak detecting operation of the developing device 122 of yellow color is started (Step S171 in FIG. 11). Here, the first detection starting voltage VA is calculated by VA=VNy1-150 (V). 150V in this equation is defined as a first potential difference. Note that the first potential difference may be set at 100 V as in the first embodiment. Since the first leak generating voltage VNy1 detected in the first leak detecting operation was 1400 V, the first detection starting voltage VA is 1400−150=1250 V and shown in step J-1 of the second leak detecting operation of yellow color in TABLE-1 and FIG. 10.

This embodiment is characterized by having Steps S173 and S174 of FIG. 11. The leak detection controller 93 determines whether or not a leak is generated at the inter-peak voltage Vy21 for which the first detection starting voltage VA was adopted (Step S173 of FIG. 11). In the previous first embodiment, if a leak is generated at the first detection starting voltage VA in Step S133 of FIG. 8, this first detection starting voltage VA is set as the first leak generating voltage VNy2 (Step S135 of FIG. 8). However, there is actually a possibility of the existence of a more appropriate leak generating voltage (first leak generating voltage VNy2) having a voltage value smaller than the first detection starting voltage VA. Further, if the first detection starting voltage VA is set closer to the first leak generating voltage VNy1 of the first leak detecting operation to complete the second leak detecting operation in a short time, a leak is easily generated at the first detection starting voltage VA.

In this embodiment, in light of the above event, the leak detection controller 93 sets the next inter-peak voltage Vy21 as a second detection starting voltage VB (Vy21=VA-150 (V)) if a leak is generated at the inter-peak voltage Vy21 for which the first detection starting voltage VA was adopted (YES in Step S173 of FIG. 11). Note that since the first detection starting voltage VA was 1250 V, the second detection starting voltage VB is 1250−150=1100 V. In FIG. 10, the second detection starting voltage VB is shown in step G-1 of the second leak detecting operation.

Accordingly, the leak detection controller 93 resumes the leak detection from the second detection starting voltage VB lower than the first detection starting voltage VA by the first potential difference. If no leak is generated at the second detection starting voltage VB (NO in Steps S173 and S175 of FIG. 11), the leak detection is repeated while the inter-peak voltage is increased at the first potential interval α as in Step S134 of FIG. 8 (Steps S176, S175 of FIG. 11). As a result, even if a leak is generated at the first detection starting voltage VA, an appropriate leak generating voltage VF (first leak generating voltage VNy2) having a smaller voltage value than the first detection starting voltage VA can be detected (Step S177 of FIG. 11).

Note that, in FIG. 11, a flow from Step S177 to Step S185 is similar to that from Step S135 to Step S143 of FIG. 8. In Step S185 of FIG. 11, the leak generating voltage VF in the second leak detecting operation of yellow color is determined.

As just described, in the second embodiment, the leak detecting operation is resumed from the second detection starting voltage VB lower than the first detection starting voltage VA by the second potential difference (150 V in Step S174 of FIG. 11) if a leak is generated at the first detection starting voltage VA in the second or subsequent leak detecting operation. According to this configuration, an appropriate leak generating voltage VF can be detected even if a leak is generated when the second or subsequent leak detecting operation is started. At this time, the second potential difference is set not smaller than the aforementioned first potential difference and the second detection starting voltage VB is set higher than the reference detection starting voltage V0. As a result, the number of steps of the leak detecting operation can be reduced and the appropriate leak generating voltage VF (first leak generating voltage VNy2) can be detected. Further, the occurrence of a leak can be suppressed as much as possible when the leak detecting operation is resumed even if a leak is generated when the second or subsequent leak detecting operation is started.

TABLE-3 is a table showing the numbers of steps of the leak detecting operations according to this embodiment.

TABLE 3

| | | Steps |
|---|---|---|
| | Total Step 3 | |
| $1^{st}$ Color | $1^{st}$ | 15 |
| | $2^{nd}$ | 15 |
| | $3^{rd}$ | 15 |
| | Total Step 4 | |
| $1^{st}$ Color | $1^{st}$ | 15 |
| | $2^{nd}$ | 6 |
| | $3^{rd}$ | 6 |

With reference to TABLE-3, it is assumed that the same leak detecting operation as the first leak detecting operation (15 steps) of yellow color of FIG. 6 is performed three times in the developing device 122 of yellow color in other leak detecting operations to be compared with the leak detecting operations according to this embodiment. In this case, total step 3 is as many as 45 steps. On the other hand, as shown in FIG. 10, three leak detecting operations of yellow color are respectively completed with 15, 5 and 5 steps in this embodiment. As a result, total step 4 of this embodiment is reduced to 27 steps and the leak detecting operations are completed with the number of steps which is about 60% of total step 3. As just described, in this embodiment, it is possible to shorten a time required for the leak detecting operations while maintaining the accuracy of the leak detecting operations.

Figure 13:
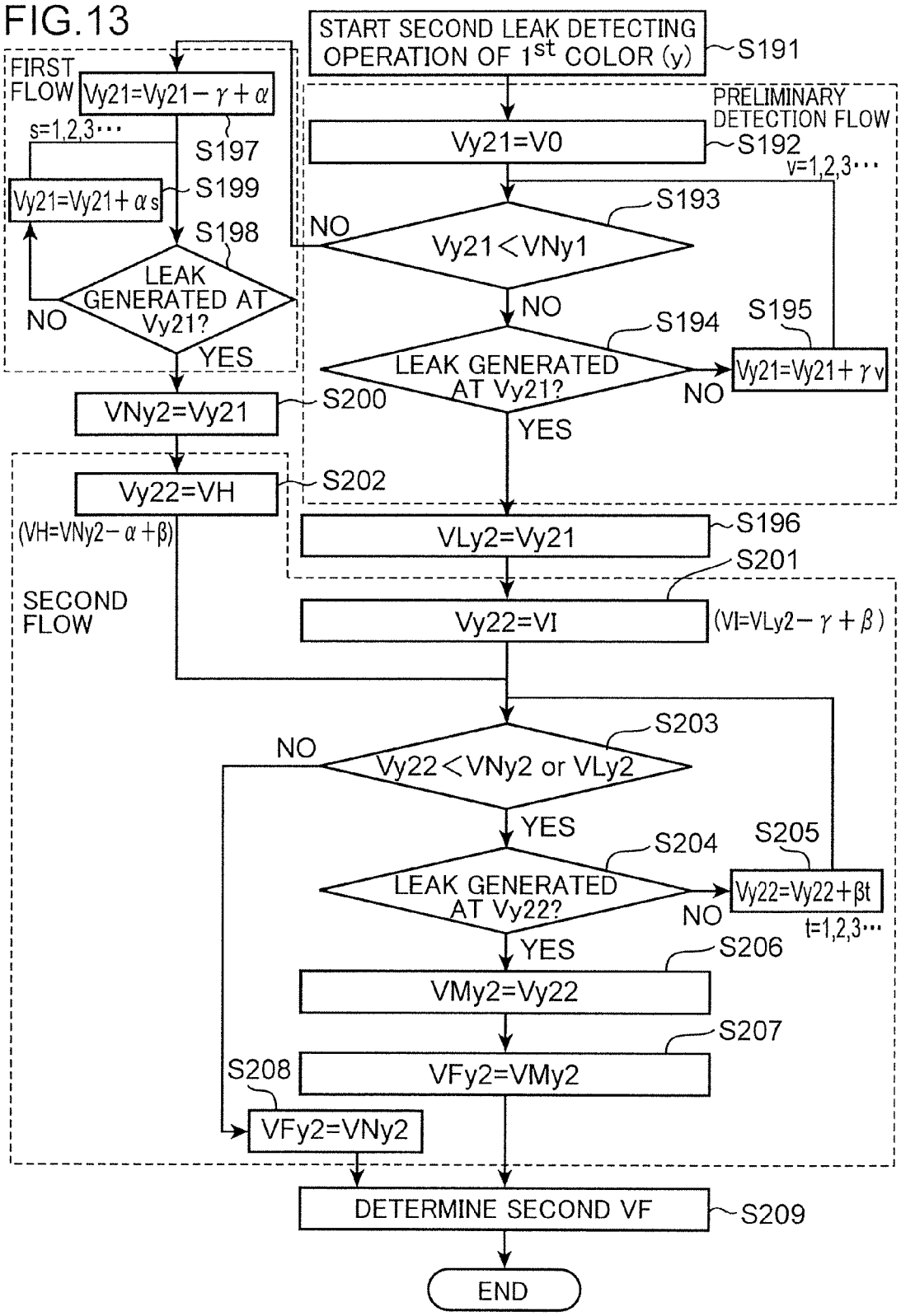
FIG. 13 is a flow chart showing a part of the leak detecting operation according to the third embodiment of the present disclosure.

Next, a third embodiment of the present disclosure is described with reference to FIGS. 12 and 13. FIG. 12 is a diagram showing steps of leak detecting operations according to the third embodiment. FIG. 13 is a flow chart showing a part of the leak detecting operation according to the third embodiment. FIG. 13 corresponds to the flow chart of the second leak detecting operation of yellow color. In the third embodiment, the leak detecting operation of yellow color to be successively performed a plurality of times is described. Note that since the third embodiment differs from the previous first embodiment in that a preliminary detection flow is provided before the first flow of the second leak detecting operation, description is made, centering on this point of difference and common points are not described.

As in the previous first embodiment, a first leak detecting operation of yellow color is performed as shown in FIGS. 7 and 10. As a result, a first leak generating voltage VNy1 and a second leak generating voltage VMy1 of the first leak detecting operation of yellow color are stored in the storage (Steps S115 and S120 of FIG. 7, M-1 and L-3 of the first leak detecting operation of FIG. 12). Further, a leak generating voltage VF in the first leak detecting operation of yellow color is determined (Step S123 of FIG. 7).

On the other hand, with reference to FIG. 13, the leak detection controller 93 performs the preliminary detection flow (first preliminary detecting operation) when the second leak detecting operation of the developing device 122 of yellow color is started (Step S191 in FIG. 13). Here, the leak detection controller 93 adopts the previous reference detection starting voltage V0 as a first inter-peak voltage Vy21

(Step S192 of FIG. 13). Then, the leak detection controller 93 determines whether or not the first inter-peak voltage Vy21 for which the reference detection starting voltage V0 was adopted is lower than the first leak generating voltage VNy1 in the first leak detecting operation (Step S193). Since Vy21<VNy1 holds (YES in Step S193) when the preliminary detection flow is started, the leak detection controller 93 causes the leak detecting unit 89 to detect whether or not a leak is generated at the inter-peak voltage Vy21 (Step S194). If no leak is generated (NO in Step S194), the leak detection controller 93 sets a value obtained by adding γ×v to the inter-peak voltage Vy21 as a new inter-peak voltage Vy21 (Step S195). Note that v is a natural number similarly to s and incremented by 1 every time Step S195 is repeated. Further, γ is a third potential interval and set larger than the previous first potential interval α. In this embodiment, γ=100 V. The preliminary detection flow is shown in steps from A-1 to I-1 in the second leak detecting operation of FIG. 12.

If a leak is generated (YES in Step S194 of FIG. 13) while the preliminary detection flow of Steps from S193 to S195 of FIG. 13 is repeated, the leak detection controller 93 stores the inter-peak voltage Vy21 at this time as a preliminary detection leak generating voltage VL in the storage (Step S196). On the other hand, if no leak is generated in the preliminary detection flow and the inter-peak voltage Vy21 being increased exceeds the first leak generating voltage VNy1 (NO in Step S193), the leak detection controller 93 proceeds to the normal first flow (from Step S197 to Step S199). The leak detection controller 93 sets the inter-peak voltage Vy21 when a leak is generated in the first flow as a first leak generating voltage VN in the storage (Step S200).

Thereafter, the leak detection controller 93 detects the leak generating voltage in detail in a second flow as in Steps from S116 to S123 of FIG. 7. Note that if a leak is generated in the preliminary detection flow, a preliminary supplementary detection starting voltage V1 is calculated based on the previously stored preliminary detection leak generating voltage VL (Step S201 of FIG. 13) and the second flow is started from the preliminary supplementary detection starting voltage V1. On the other hand, if a leak is generated in the first flow, a supplementary detection starting voltage VH is calculated based on the previously stored first leak generating voltage VN (Step S202 of FIG. 13) and the second flow is started from the supplementary detection starting voltage VH.

As just described, in this embodiment, the leak detection controller 93 performs the preliminary detection flow (first preliminary detecting operation) for detecting a leak while increasing the inter-peak voltage at the third potential interval γ from the reference detection starting voltage V0 until the first detection starting voltage VA is reached before the inter-peak voltage is increased from the first detection starting voltage VA in the second or subsequent leak detecting operation. Thus, the preliminary detection is performed with a smaller number of steps in an area from the reference detection starting voltage V0 to the first detection starting voltage VA, wherefore erroneous detection is prevented and the leak detecting operation is accurately performed. At this time, since the inter-peak voltage is increased at the third potential interval γ larger than the first potential interval α in the preliminary detection flow, a drastic increase in the number of steps of the leak detecting operation associated with the introduction of the preliminary detection flow is prevented.

TABLE-4 is a table showing the numbers of steps of the leak detecting operations according to this embodiment.

TABLE 4

| | | Steps |
|---|---|---|
| | Total Step 5 | |
| $1^{st}$ Color | $1^{st}$ | 15 |
| | $2^{nd}$ | 15 |
| | $3^{rd}$ | 15 |
| | Total Step 6 | |
| $1^{st}$ Color | $1^{st}$ | 15 |
| | $2^{nd}$ | 10 |
| | $3^{rd}$ | 10 |

With reference to TABLE-4, it is assumed that the same leak detecting operation as the first leak detecting operation (15 steps) of yellow color of FIG. 6 is performed three times in the developing device 122 of yellow color in other leak detecting operations to be compared with the leak detecting operations according to this embodiment. In this case, total step 5 is as many as 45 steps. On the other hand, as shown in FIG. 12, three leak detecting operations of yellow color are respectively completed with 15, 10 and 10 steps in this embodiment. As a result, it is possible to perform the preliminary flow while reducing total step 6 of this embodiment to 35 steps. As just described, also in this embodiment, it is possible to shorten a time required for the leak detecting operations while maintaining the accuracy of the leak detecting operations.

Although the image forming apparatus 1 according to the embodiments of the present disclosure is described above, the present disclosure is not limited to this. For example, the following modifications can be adopted.

(1) In the above third embodiment, the leak detection controller 93 proceeds to the normal first flow (from Step S197 to Step S199) if no leak is generated in the preliminary detection flow of FIG. 13 and the inter-peak voltage Vy21 being increased exceeds the first leak generating voltage VNy1 (NO in Step S193). The present disclosure is not limited to this. FIG. 14 is a diagram showing steps of leak detecting operations according to a modification of the present disclosure.

In this modification, the leak detection controller 93 proceeds to the second flow without proceeding to the first flow after a preliminary flow (steps from A-1 to I-1 of a second leak detecting operation of FIG. 14) is completed. Specifically, as shown in FIG. 14, the leak detection controller 93 performs leak detection (steps from K-1 to L-3 of the second leak detecting operation of FIG. 14) while increasing the inter-peak voltage at the second potential interval β (10 V in FIG. 14) from the first detection starting voltage VA. Even in this case, the leak detecting operation is accurately performed since the preliminary detection is performed in the area from the reference detection starting voltage V0 to the first detection starting voltage VA.

Further, FIG. 15 is a diagram showing steps of leak detecting operations according to another modification of the present disclosure. In this modification, the leak detection controller 93 performs a preliminary detection flow (second preliminary detecting operation) different from that of the previous third embodiment before increasing the inter-peak voltage from the first detection starting voltage VA (step K-1 of a second leak detecting operation of FIG. 15). In this preliminary detection flow, the leak detection controller 93 starts increasing the inter-peak voltage at the third potential interval γ larger than the first potential interval α from the reference detection starting voltage V0 (steps from A-1 to E-1 of the second leak detecting operation of FIG. 15) and detects a leak until the first detection starting voltage VA is reached while reducing the potential interval from the third potential interval γ (steps from E-1 to J-1 of the second leak detecting operation of FIG. 15). Even in this case, a drastic increase in the number of steps of the leak detecting operation associated with the introduction of the preliminary detection flow is prevented. Further, since the second preliminary detecting operation is performed with a smaller number of steps from the reference detection starting voltage V0, erroneous detection is prevented and the leak detecting operation is accurately performed.

(2) In the above first embodiment, the first leak generating voltage VNy1 of the first leak detecting operation of yellow color is referred to for the first detection starting voltage VA (Step S132 of FIG. 8) when the second leak detecting operation of yellow color is started. Further, the first leak generating voltage VNy1 of the first leak detecting operation of yellow color is referred to for the first detection starting voltage VA (Step S152 of FIG. 9) when the first leak detecting operation of magenta color is started. The present disclosure is not limited to this. TABLE-5 and TABLE-6 below are tables showing patterns of reference destinations of the first detection starting voltage VA in a modification of the present disclosure. In TABLE-5, after three leak detecting operations are performed for the first color (yellow color), three leak detecting operations are successively and similarly performed for each color. Further, in TABLE-6, after one leak detecting operation is performed for each color, similar operations are repeated three times. In any case, the first leak generating voltage VN or the second leak generating voltage VM referred to for the first detection starting voltage VA is underlined.

TABLE 5

| | | 1st Color (y) | | | 2nd Color (m) | | |
|---|---|---|---|---|---|---|---|
| | | 1st | 2nd | 3rd | 1st | 2nd | 3rd |
| Pattern 1 | VA | V0 | VNy1-X | VNy2-X | VNy3-Y | VNm1-X | VNm2-X |
| | VN | VNy1 | VNy2 | VNy3 | VNm1 | VNm2 | VNm3 |
| | VM | VMy1 | VMy2 | VMy3 | VMm1 | VMm2 | VMm3 |
| Pattern 2 | VA | V0 | VNy1-X | VNy1-X | VNy1-Y | VNy2-Y | VNy3-Y |
| | VN | VNy1 | VNy2 | VNy3 | VNm1 | VNm2 | VNm3 |
| | VM | VMy1 | VMy2 | VMy3 | VMm1 | VMm2 | VMm3 |
| Pattern 3 | VA | V0 | VMy1-X | VMy2-X | VMy3-Y | VMm1-X | VMm2-X |
| | VN | VNy1 | VNy2 | VNy3 | VNm1 | VNm2 | VNm3 |
| | VM | VMy1 | VMy2 | VMy3 | VMm1 | VMm2 | VMm3 |
| | | 3rd Color (c) | | | 4th Color (k) | | |
| | | 1st | 2nd | 3rd | 1st | 2nd | 3rd |
| Pattern 1 | VA | VNm3-Y | VNc1-X | VNc2-X | VNc3-Y | VNk1-X | VNk2-X |
| | VN | VNc1 | VNc2 | VNc3 | VNk1 | VNk2 | VNk3 |
| | VM | VMc1 | VMc2 | VMc3 | VMk1 | VMk2 | VMk3 |
| Pattern 2 | VA | VNm1-Y | VNm2-Y | VNm3-Y | VNc1-Y | VNc2-Y | VNc3-Y |
| | VN | VNc1 | VNc2 | VNc3 | VNk1 | VNk2 | VNk3 |
| | VM | VMc1 | VMc2 | VMc3 | VMk1 | VMk2 | VMk3 |
| Pattern 3 | VA | VMm3-Y | VMc1-X | VMc2-X | VMc3-Y | VMk1-X | VMk2-X |
| | VN | VNc1 | VNc2 | VNc3 | VNk1 | VNk2 | VNk3 |
| | VM | VMc1 | VMc2 | VMc3 | VMk1 | VMk2 | VMk3 |

VA: first detection starting voltage,
VN: first leak generating voltage,
VM: second leak generating voltage In pattern 1 of TABLE-5, the first leak generating voltage VN of the first leak detecting operation of yellow color is referred to for the first detection starting voltage VA of the second leak detecting operation of yellow color. Note that X is the aforementioned first potential difference and a potential difference used in the same developing device. Similarly, the first leak generating voltage VN of the second leak detecting operation of yellow color is referred to for the first detection starting voltage VA of the third leak detecting operation of yellow color. Further, the first leak generating voltage VN of the third leak detecting operation of yellow color is referred to for the first detection starting voltage VA of the first leak detecting operation of magenta color. Furthermore, the first leak generating voltage VN of the first leak detecting operation of magenta color is referred to for the first detection starting voltage VA of the second leak detecting operation of magenta color. Note that Y is the aforementioned first potential difference and a potential difference used among different developing devices. Thereafter, the first or second leak generating voltage VN or VM is referred to for magenta color, cyan color and black color in accordance with a similar rule.

In pattern 2 of TABLE-5, the first leak generating voltage VN of the first leak detecting operation of yellow color is referred to for the first detection starting voltage VA of the second leak detecting operation of yellow color. Further, the first leak generating voltage VN of the first leak detecting operation of yellow color is referred to also for the first detection starting voltage VA of the third leak detecting operation of yellow color. Furthermore, the first leak generating voltage VN of the first leak detecting operation of yellow color is referred to for the first detection starting voltage VA of the first leak detecting operation of magenta color. The first leak generating voltage VN of the second leak detecting operation of yellow color is referred to for the first detection starting voltage VA of the second leak detecting operation of magenta color. The first leak generating voltage VN of the third leak detecting operation of magenta color is referred to for the first detection starting voltage VA of the third leak detecting operation of magenta color. Thereafter, the first or second leak generating voltage VN or VM is referred to for magenta color, cyan color and black color in accordance with a similar rule.

In pattern 3 of TABLE-5, the second leak generating voltage VM of the first leak detecting operation of yellow color is referred to for the first detection starting voltage VA of the second leak detecting operation of yellow color. Further, the second leak generating voltage VM of the second leak detecting operation of yellow color is referred to for the first detection starting voltage VA of the third leak detecting operation of yellow color. Furthermore, the second leak generating voltage VM of the third leak detecting operation of yellow color is referred to for the first detection starting voltage VA of the first leak detecting operation of magenta color. The second leak generating voltage VM of the first leak detecting operation of magenta color is referred to for the first detection starting voltage VA of the second leak detecting operation of magenta color. The second leak generating voltage VM of the second leak detecting operation of magenta color is referred to for the first detection starting voltage VA of the third leak detecting operation of magenta color. Thereafter, the first or second leak generating voltage VN or VM is referred to for magenta color, cyan color and black color in accordance with a similar rule.

TABLE 6

| | | 1st | | | | 2nd | |
|---|---|---|---|---|---|---|---|
| | | 1st Color | 2nd Color | 3rd Color | 4th Color | 1st Color | 2nd Color |
| Pattern 4 | VA | V0 | VNy1-X | VNm1-X | VNc1-Y | VNy1-X | VNm1-X |
| | VN | VNy1 | VNm1 | VNc1 | VNk1 | VNy2 | VNm2 |
| | VM | VMy1 | VMm1 | VMc1 | VMk1 | VMy2 | VMm2 |
| Pattern 5 | VA | V0 | VNy1-Y | VNm1-Y | VNc1-Y | VNk1-Y | VNy2-Y |
| | VN | VNy1 | VNm1 | VNc1 | VNk1 | VNy2 | VNm2 |
| | VM | VMy1 | VMm1 | VMc1 | VMk1 | VMy2 | VMm2 |
| Pattern 6 | VA | V0 | VMy1-Y | VMm1-Y | VMc1-Y | VMk1-X | VMm1-X |
| | VN | VNy1 | VNy2 | VNy3 | VNm1 | VNm2 | VNm3 |
| | VM | VMy1 | VMy2 | VMy3 | VMm1 | VMm2 | VMm3 |

| | | 2nd | | 3rd | | | |
|---|---|---|---|---|---|---|---|
| | | 3rd Color | 4th Color | 1st Color | 2nd Color | 3rd Color | 4th Color |
| Pattern 4 | VA | VNc1-X | VNk1-X | VNy2-X | VNm2-X | VNc2-X | VNk2-X |
| | VN | VNc2 | VNk2 | VNy3 | VNm3 | VNc3 | VNk3 |
| | VM | VMc2 | VMk2 | VMy3 | VMm3 | VMc3 | VMk3 |
| Pattern 5 | VA | VNm2-Y | VNc2-Y | VNk2-Y | VNy3-Y | VNm3-Y | VNc3-Y |
| | VN | VNc2 | VNk2 | VNy3 | VNm3 | VNc3 | VNk3 |
| | VM | VMc2 | VMk2 | VMy3 | VMm3 | VMc3 | VMk3 |
| Pattern 6 | VA | VMc1-X | VMk1-X | VMy2-X | VMm2-X | VMc2-X | VMk2-X |
| | VN | VNc1 | VNc2 | VNc3 | VNk1 | VNk2 | VNk3 |
| | VM | VMc1 | VMc2 | VMc3 | VMk1 | VMk2 | VMk3 |

VA: first detection starting voltage,
VN: first leak generating voltage,
VM: second leak generating voltage In pattern 4 of TABLE-6, the first leak generating voltage VN of the first leak detecting operation of yellow color is referred to for the first detection starting voltage VA of the first leak detecting operation of magenta color. Further, the first leak generating voltage VN of the first leak detecting operation of magenta color is referred to for the first detection starting voltage VA of the first leak detecting operation of cyan color. Furthermore, the first leak generating voltage VN of the first leak detecting operation of cyan color is referred to for the first detection starting voltage VA of the first leak detecting operation of black color. The first leak generating voltage VN of the first leak detecting operation of yellow color is referred to again for the first detection starting voltage VA of the second leak detecting operation of yellow color. The first leak generating voltage VN of the first leak detecting operation of magenta color is referred to for the first detection starting voltage VA of the second leak detecting operation of magenta color. Thereafter, the first or second leak generating voltage VN or VM is referred to for magenta color, cyan color and black color in accordance with a similar rule.

In pattern 5 of TABLE-6, the first leak generating voltage VN of the first leak detecting operation of yellow color is referred to for the first detection starting voltage VA of the first leak detecting operation of magenta color. Further, the first leak generating voltage VN of the first leak detecting operation of magenta color is referred to for the first detection starting voltage VA of the first leak detecting operation of cyan color. Furthermore, the first leak generating voltage VN of the first leak detecting operation of cyan color is referred to for the first detection starting voltage VA of the first leak detecting operation of black color. The first leak generating voltage VN of the first leak detecting operation of black color is referred to for the first detection starting voltage VA of the second leak detecting operation of yellow color. The first leak generating voltage VN of the second leak detecting operation of yellow color is referred to for the first detection starting voltage VA of the second leak detecting operation of magenta color. Thereafter, the first or second leak generating voltage VN or VM is referred to for magenta color, cyan color and black color in accordance with a similar rule.

In pattern 6 of TABLE-6, the second leak generating voltage VM of the first leak detecting operation of yellow color is referred to for the first detection starting voltage VA of the first leak detecting operation of magenta color. Further, the second leak generating voltage VM of the first leak detecting operation of magenta color is referred to for the first detection starting voltage VA of the first leak detecting operation of cyan color. Furthermore, the second leak generating voltage VM of the first leak detecting operation of cyan color is referred to for the first detection starting voltage VA of the first leak detecting operation of black color. The second leak generating voltage VM of the first leak detecting operation of yellow color is referred to for the first detection starting voltage VA of the second leak detecting operation of yellow color. The second leak generating voltage VM of the first leak detecting operation of magenta color is referred to for the first detection starting voltage VA of the second leak detecting operation of magenta color. Thereafter, the first or second leak generating voltage VN or VM is referred to for magenta color, cyan color and black color in accordance with a similar rule.

As just described, in this embodiment, the first detection starting voltage VA in the second or subsequent leak detecting operation is set lower than the leak generating voltage VF (first or second leak generating voltage VN or VM) in the previously performed leak detecting operation by the first potential difference (X or Y).

Figure 16:
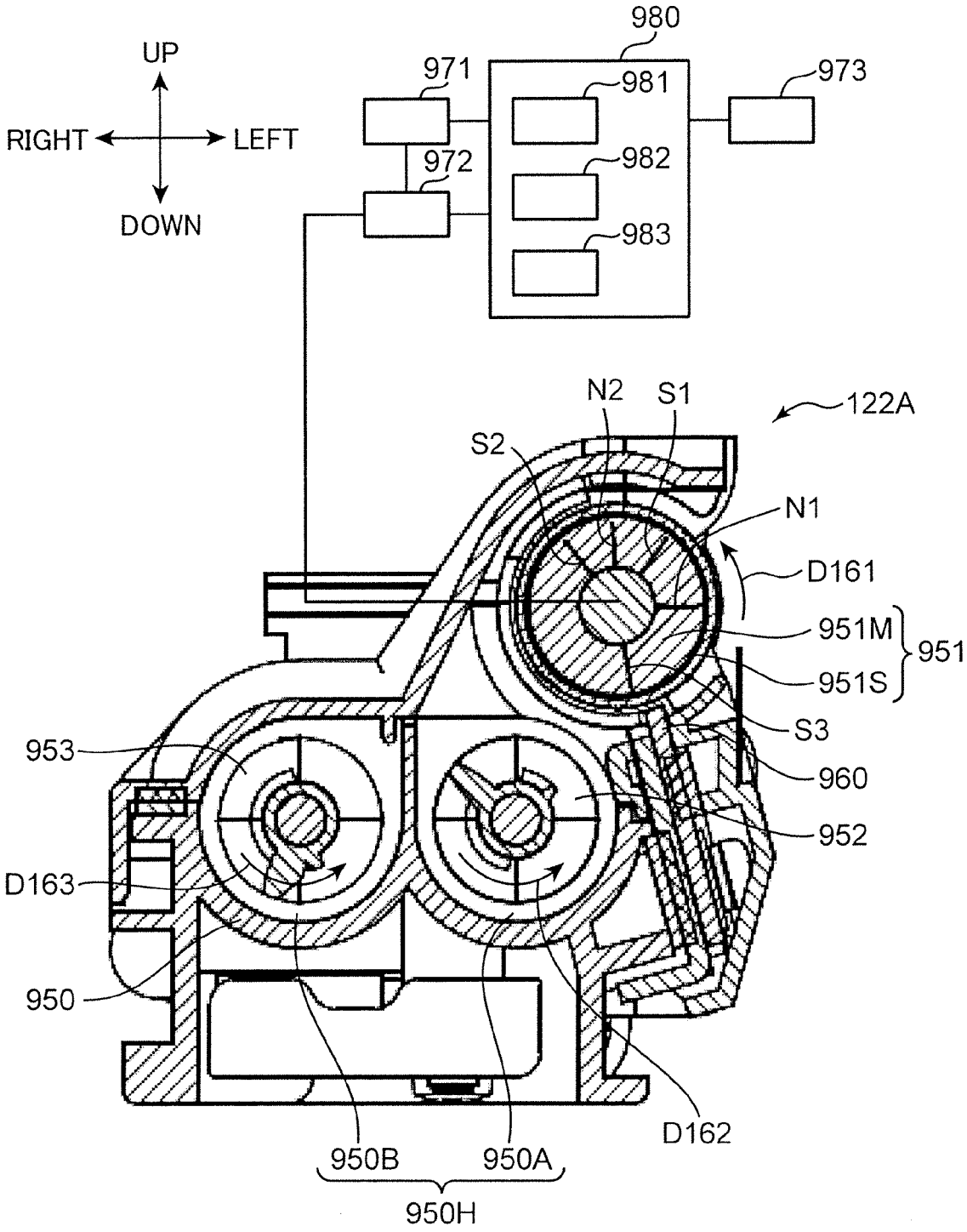
FIG. 16 is a sectional view of a developing device and a block diagram showing the electrical configuration of a control unit of an image forming apparatus according to a modification of the present disclosure.

(3) Further, although the above embodiments are described using the developing device 122 which includes the developing roller 83 and the magnetic roller 82 and to which the touch-down development method is applied, the present disclosure is not limited to this. FIG. 16 shows a sectional view of a developing device 122A and a block diagram showing the electrical configuration of a control unit 980 according to a modification of the present disclosure. The developing device 122A includes a development housing 950, a developing roller 951, a first screw feeder 952, a second screw feeder 953 and a restricting blade 960. A two-component development method is applied to the developing device 122A.

The development housing 950 is provided with a developer storing unit 950H. Two-component developer composed of toner and carrier is stored in the developer storing unit 950H. Further, the developer storing unit 950H includes a first feeding unit 950A in which the developer is fed in a first feeding direction (direction perpendicular to the plane of FIG. 16, direction from a rear side toward a front side) from one axial end side toward the other axial side of the developing roller 951 and a second feeding unit 950B which communicates with the first feeding unit 950A at opposite axial end parts and in which the developer is fed in a second feeding direction opposite to the first feeding direction. The first and second screw feeders 952, 953 are rotated in directions of arrows D162, D163 of FIG. 16 and respectively feed the developer in the first and second feeding directions. Particularly, the first screw feeder 952 supplies the developer to the developing roller 951 while feeding the developer in the first feeding direction.

The developing roller 951 is arranged at a distance from an unillustrated photoconductive drum (image carrier) on a surface of which an electrostatic latent image is to be formed. The developing roller 951 includes a rotary sleeve 951S and a magnet 951M fixedly arranged in the sleeve 951S. The magnet 951M has poles S1, N1, S2, N2 and S3. The developing roller 951 is rotated in a direction of an arrow D161 of FIG. 16. The developing roller 951 receives the developer in the development housing 950, carries a developer layer and supplies toner to the photoconductive drum.

The restricting blade 960 is arranged at a predetermined distance from the developing roller 951 and restricts a thickness of a layer of the developer supplied onto the circumferential surface of the developing roller 951 from the first screw feeder 952.

An image forming apparatus (not shown) into which the developing device 122A is to be mounted includes a development bias applying unit 972 (bias applying unit), a leak detecting unit 971, a control unit 980 and a driving unit 973.

The development bias applying unit 972 is composed of a direct current power supply and an alternating current power supply and applies a development bias, in which an alternating current voltage is superimposed on a direct current voltage, to the developing roller 951 of the developing device 122A based on a control signal from a bias controller 982 or a leak detection controller 983 to be described later.

The leak detecting unit 971 is electrically connected to the development bias applying unit 972. The leak detecting unit 971 detects a leak generated between the photoconductive drum and the developing roller 951. Specifically, the leak detecting unit 971 detects the leak by detecting a variation of the value of a current flowing into the developing roller 951 (overcurrent).

The driving unit 973 is composed of a motor and a gear mechanism for transmitting a torque of the motor, and drives and rotates the developing roller 951 and the first and second screw feeders 952, 953 in the developing device 122A in addition to the photoconductive drum during a developing operation and a leak detecting operation in response to a control signal from the control unit 980 as in the previous embodiments.

The control unit 980 functions to include a drive controller 981, the bias controller 982 and the leak detection controller 983 by the CPU executing the control program stored in the ROM.

The drive controller 981 drives and rotates the developing roller 951, the first and second screw feeders 952, 953 by controlling the driving unit 973. Further, the drive controller 981 drives and rotates the photoconductive drum by controlling the unillustrated driving mechanism. In this modification, the drive controller 981 drives and rotates each of the above members in the developing operation and the leak detecting operation.

The bias controller 982 provides potential differences in the alternating current voltage and the direct current voltage between the photoconductive drum and the developing roller 951 by controlling the development bias applying unit 972 during the developing operation in which the toner is supplied from the developing roller 951 to the photoconductive drum. Due to the potential differences, the toner is moved from the developing roller 951 to the photoconductive drum.

The leak detection controller 983 applies the direct current voltage and the alternating current voltage to the developing roller 951 by controlling the development bias applying unit 972 during the leak detecting operation. In the leak detecting operation, out of the development bias applied to the developing roller 951, an inter-peak voltage of the alternating current voltage at which the leak is generated is detected. At this time, the leak detection controller 983 generates a leak between the photoconductive drum and the developing roller 951 while increasing the inter-peak voltage of the alternating current voltage of the development bias. Also in this modification, the leak detecting operation is performed prior to the developing operation, i.e. at a time different from that during the developing operation, and the inter-peak voltage (leak generating voltage) at which a leak is generated is detected. As a result, during the developing operation, the inter-peak voltage of the alternating current voltage is set in such a range as not to reach the leak generating voltage and the occurrence of a leak is prevented.

Also in this modification, the leak detection controller 983 successively performs a plurality of leak detecting operations at predetermined timings. In the first one of the plurality of leak detecting operations, the leak detection controller 983 increases the inter-peak voltage from the preset reference detection starting voltage V0 and detects the inter-peak voltage when a leak is detected as the leak generating voltage VF. Further, in the second or subsequent leak detecting operation, the leak detection controller 983 increases the inter-peak voltage from the first detection starting voltage VA calculated according to the already detected leak generating voltage VF and higher than the reference detection starting voltage V0 and detects the inter-peak voltage when a leak is detected as the next leak generating voltage VF. As a result, the number of steps required for the second or subsequent leak detecting operation out of the leak detecting operations performed a plurality of times can be reduced. Note that a control similar to that of each previous embodiment can be executed as a detailed control of each leak detecting operation in this modification. Further, even if a plurality of the developing devices 122A are arranged in accordance with a plurality of colors, the number of steps required for the leak detecting operation can be reduced.

Note that an example of the development bias applied to the developing roller 951 by the bias controller 982 controlling the development bias applying unit 972 during the developing operation is as follows.

Direct current voltage Vslv_dc of developing roller 951: 200 V

Alternating current voltage (Vpp) Vslv_ac of developing roller 951: 1400 V (3.0 kHz)

Gap between developing roller 951 and photoconductive drum: 0.3 mm

Surface roughness Rz of developing roller 951: 5.5 μm

Duty ratio (Duty 1) of alternating current voltage of developing roller 951: 50%

Image part potential VL of photoconductive drum: +30 V

Background part potential Vo of photoconductive drum: +300 V

Photoconductive drum: a-Si photoconductor

Feeding amount of developer on developing roller 951: 8 $mg/cm^2$

Further, the development bias to be applied to the developing roller 951 by the leak detection controller 983 controlling the development bias applying unit 972 during the leak detecting operation is described. In the case of the touch-down development method as shown in FIG. 2, the leak detecting operation is performed in a state where no toner layer is formed on the developing roller 83. Thus, even if an electrostatic latent image on the photoconductive drum 121 is an image part, the toner is hardly developed on the side of the photoconductive drum 121. Further, since a potential in a direction to develop the toner is set on the image part on the photoconductive drum 121, electric charges having a positive polarity are easily injected to the photoconductive drum 121. Accordingly, the leak detecting operation is performed to generate a leak in the image part of the photoconductive drum 121. This is to prevent the injection of electric charges having a negative polarity (polarity opposite to that of the image part of the photoconductive drum 121) to the surface of the photoconductive drum 121. If electric charges having an opposite polarity are injected to the photoconductive drum 121, these electric charges are difficult to escape. Thus, an error is likely to occur in the next leak detecting operation.

On the other hand, in the case of the two-component development method as shown in FIG. 16, a magnetic brush is formed in a development area of the developing roller 951. Thus, if the leak detecting operation is performed in the image part on the photoconductive drum, the toner is consumed at the side of the photoconductive drum simultaneously with leak detection. Accordingly, to suppress this toner consumption, the leak detecting operation needs to be performed in a blank part (background part) of the photoconductive drum 121. Also in this case, a possibility of developing the carrier on the photoconductive drum side is increased if V0 (background part potential)−Vslv_dc>150 (V) during the leak detection. Thus, the leak detecting operation is performed in a state where a potential difference V0−Vslv_dc is set at about 50 to 100 V.

Note that although toner consumption is suppressed if the leak detecting operation is performed in the blank part of the photoconductive drum, electric charges having an opposite polarity (here, negative polarity) may be applied to the surface of the photoconductive drum and may affect the next leak detecting operation. Accordingly, in the case of the two-component development method, a transfer bias to be applied to a transfer member (member facing the photoconductive drum such as a transfer roller) is set to have the same polarity (here, positive polarity) as the photoconductive drum. As a result, even if electric charges having a negative polarity are applied to the photoconductive drum, electric charges on the photoconductive drum and those of the transfer member cancel each other. As a result, it is possible to remove unnecessary electric charges from the photoconductive drum. Note that specific conditions during the leak detecting operation when the two-component development method is adopted are listed below.

Direct current voltage Vslv_dc of developing roller 951: 250 V

Alternating current voltage (Vpp) Vslv_ac of developing roller 951: variable (3.0 kHz)

Duty ratio of alternating current voltage of developing roller 951: 50%

Image part potential VL of photoconductive drum: +30 V

Background part potential Vo of photoconductive drum: +300 V

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an image carrier on a surface of which an electrostatic latent image is to be formed and a toner image is to be carried;

a developing device which includes a development housing configured to store developer containing toner to be charged to a predetermined polarity and carrier, a magnetic roller configured to receive the developer in the development housing and carry a developer layer by being rotated and a developing roller configured to receive the toner from the developer layer, carry a toner layer and supply the toner to the image carrier by being rotated in a state held in contact with the developer layer;

a bias applying unit which applies development biases, in which an alternating current voltage is superimposed on a direct current voltage, to the magnetic roller and the developing roller;

a leak detecting unit which detects a leak generated between the image carrier and the developing roller or a leak generated between the developing roller and the magnetic roller;

a bias controller which controls the bias applying unit to provide a potential difference between the magnetic roller and the developing roller so that the toner moves from the magnetic roller to the developing roller during a developing operation in which the toner is supplied from the developing roller to the image carrier; and a leak detection controller which performs a leak detecting operation for detecting the value of an inter-peak voltage of the alternating current voltage of the development bias applied to the developing roller, at which the leak is generated, while changing the inter-peak voltage at a time different from that during the developing operation;

wherein the leak detection controller:

successively performs a plurality of the leak detecting operations at predetermined timings;

increases the inter-peak voltage from a preset reference detection starting voltage and detects the inter-peak voltage when the leak is detected as a leak generating voltage in the first one of the plurality of leak detecting operations; and increases the inter-peak voltage from a first detection starting voltage calculated according to the already detected leak generating voltage and higher than the reference detection starting voltage and detects the inter-peak voltage when the leak is detected as the next leak generating voltage in the second or subsequent leak detecting operation.

2. An image forming apparatus, comprising:

an image carrier on a surface of which an electrostatic latent image is to be formed and a toner image is to be carried;

a developing device which includes a development housing configured to store developer containing toner to be charged to a predetermined polarity and carrier and a developing roller configured to receive the developer in the development housing, carry a developer layer and supply the toner to the image carrier by being rotated;

a bias applying unit which applies a development bias, in which an alternating current voltage is superimposed on a direct current voltage, to the developing roller;

a leak detecting unit which detects a leak generated between the image carrier and the developing roller;

a bias controller which controls the bias applying unit to provide a potential difference between the image carrier and the developing roller during a developing operation in which the toner is supplied from the developing roller to the image carrier; and a leak detection controller which performs a leak detecting operation for detecting the value of an inter-peak voltage of the alternating current voltage of the development bias applied to the developing roller, at which the leak is generated, while changing the inter-peak voltage at a time different from that during the developing operation;

wherein the leak detection controller:

successively performs a plurality of the leak detecting operations at predetermined timings;

increases the inter-peak voltage from a preset reference detection starting voltage and detects the inter-peak voltage when the leak is detected as a leak generating voltage in the first one of the plurality of leak detecting operations; and increases the inter-peak voltage from a first detection starting voltage calculated according to the already detected leak generating voltage and higher than the reference detection starting voltage and detects the inter-peak voltage when the leak is detected as the next leak generating voltage in the second or subsequent leak detecting operation.

3. An image forming apparatus according to claim 1, wherein:

the first detection starting voltage in the second or subsequent leak detecting operation is set lower than the leak generating voltage in the previously performed leak detecting operation by a first potential difference.

4. An image forming apparatus according to claim 3, wherein:

the leak detection controller resumes the leak detecting operation from a second detection starting voltage lower than the first detection starting voltage by a second potential difference if the leak is generated at the first detection starting voltage in the second or subsequent leak detecting operation.

5. An image forming apparatus according to claim 4, wherein:

the second potential difference is set not smaller than the first potential difference and the second detection starting voltage is higher than the reference detection starting voltage.

6. An image forming apparatus according to claim 1, wherein:

the plurality of leak detecting operations are the leak detecting operations repeatedly performed for the same developing device.

7. An image forming apparatus according to claim 6, wherein:

the inter-peak voltage applied to the developing roller during the developing operation is set based on an average value or a minimum value of a plurality of leak generating voltages obtained by the plurality of leak detecting operations.

8. An image forming apparatus according to claim 1, wherein:

a plurality of the developing devices are arranged in accordance with a plurality of colors; and the plurality of leak detecting operations are the leak detecting operations successively performed for different developing devices.

9. An image forming apparatus according to claim 8, wherein:

the plurality of leak detecting operations are performed a plurality of times for each developing device; and the inter-peak voltage applied to the developing roller during the developing operation of each developing device is set based on an average value or a minimum value of a plurality of leak generating voltages obtained by the plurality of leak detecting operations in each developing device.

10. An image forming apparatus according to claim 3, wherein:

a plurality of the developing devices are arranged in accordance with a plurality of colors;

the plurality of leak detecting operations include a first leak detecting operation group repeatedly performed for the same developing device and a second leak detecting operation group successively performed for different developing devices; and the first potential difference in the second leak detecting operation group is set larger than that in the first leak detecting operation group.

11. An image forming apparatus according to claim 1, wherein:

the leak detection controller increases the inter-peak voltage at a first potential interval from the reference detection starting voltage or the first detection starting voltage and detects the inter-peak voltage when a leak is first detected as a first leak generating voltage, increases the inter-peak voltage at a second potential interval smaller than the first potential interval from a third detection starting voltage lower than the first leak generating voltage by the first potential interval until the first leak generating voltage is reached, detects the inter-peak voltage when a leak is detected again as a second leak generating voltage and sets the first or second leak generating voltage as the leak generating voltage in the leak detecting operation.

12. An image forming apparatus according to claim 11, wherein:

the leak detection controller performs a first preliminary detecting operation for detecting the leak while increasing the inter-peak voltage at a third potential interval larger than the first potential interval from the reference detection starting voltage until the first detection starting voltage is reached before the inter-peak voltage is increased from the first detection starting voltage in the second or subsequent leak detecting operation.

13. An image forming apparatus according to claim 11, wherein:

the leak detection controller performs a second preliminary detecting operation for detecting the leak while increasing the inter-peak voltage at a third potential interval larger than the first potential interval from the reference detection starting voltage and while reducing the potential interval from the third potential interval until the first detection starting voltage is reached before the inter-peak voltage is increased from the first detection starting voltage in the second or subsequent leak detecting operation.

14. An image forming apparatus according to claim 2, wherein:

the first detection starting voltage in the second or subsequent leak detecting operation is set smaller than the leak generating voltage in the previously performed leak detecting operation by a first potential difference.

15. An image forming apparatus according to claim 14, wherein:

the leak detection controller resumes the leak detecting operation from a second detection starting voltage lower than the first detection starting voltage by a second potential difference if the leak is generated at the first detection starting voltage in the second or subsequent leak detecting operation.

16. An image forming apparatus according to claim 15, wherein:

the second potential difference is set not smaller than the first potential difference and the second detection starting voltage is higher than the reference detection starting voltage.

17. An image forming apparatus according to claim 2, wherein:

the plurality of leak detecting operations are the leak detecting operations repeatedly performed for the same developing device; and the inter-peak voltage applied to the developing roller during the developing operation is set based on an average value or a minimum value of a plurality of leak generating voltages obtained by the plurality of leak detecting operations.

18. An image forming apparatus according to claim 2, wherein:

a plurality of the developing devices are arranged in accordance with a plurality of colors;

the plurality of leak detecting operations are the leak detecting operations successively performed for different developing devices and performed a plurality of times for each developing device;

the inter-peak voltage applied to the developing roller during the developing operation of each developing device is set based on an average value or a minimum value of a plurality of leak generating voltages obtained by the plurality of leak detecting operations in each developing device.

19. An image forming apparatus according to claim 14, wherein:

a plurality of the developing devices are arranged in accordance with a plurality of colors;

the plurality of leak detecting operations include a first leak detecting operation group repeatedly performed for the same developing device and a second leak detecting operation group successively performed for different developing devices; and the first potential difference in the second leak detecting operation group is set larger than that in the first leak detecting operation group.

20. An image forming apparatus according to claim 2, wherein:

the leak detection controller increases the inter-peak voltage at a first potential interval from the reference detection starting voltage or the first detection starting voltage and detects the inter-peak voltage when a leak is first detected as a first leak generating voltage, increases the inter-peak voltage at a second potential interval smaller than the first potential interval from a third detection starting voltage lower than the first leak generating voltage by the first potential interval until the first leak generating voltage is reached, detects the inter-peak voltage when a leak is detected again as a second leak generating voltage and sets the first or second leak generating voltage as the leak generating voltage in the leak detecting operation.

* * * * *